US008997644B2

(12) United States Patent
Hotta

(10) Patent No.: US 8,997,644 B2
(45) Date of Patent: Apr. 7, 2015

(54) PUNCHING DEVICE, PAPER PROCESSING APPARATUS, AND IMAGE FORMING APPARATUS

(71) Applicant: Michihiro Hotta, Aichi (JP)

(72) Inventor: Michihiro Hotta, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 186 days.

(21) Appl. No.: 13/689,868

(22) Filed: Nov. 30, 2012

(65) Prior Publication Data

US 2013/0139708 A1 Jun. 6, 2013

(30) Foreign Application Priority Data

Dec. 5, 2011 (JP) ..... 2011-266064

(51) Int. Cl.

| | |
|---|---|
| ***B26D 7/18*** | (2006.01) |
| ***B26F 1/02*** | (2006.01) |
| ***B26D 7/32*** | (2006.01) |
| ***B26F 1/00*** | (2006.01) |
| *B26D 7/00* | (2006.01) |

(52) U.S. Cl.

CPC .. *B26D 7/32* (2013.01); *B26D 7/18* (2013.01); *B26F 1/0092* (2013.01); *B26D 2007/0018* (2013.01)

(58) Field of Classification Search

CPC .... B26D 7/18; B26D 2007/0018; B26F 1/02; G03G 15/6582; G03G 2215/00818

USPC ..... 101/26; 399/407; 83/681, 684, 687, 83/698.91, 162, 165, 166, 167, 691

See application file for complete search history.

(56) References Cited

U.S. PATENT DOCUMENTS

| | | | | |
|---|---|---|---|---|
| 7,735,402 | B2 * | 6/2010 | Tsuji et al. | 83/166 |
| 2005/0061131 | A1 | 3/2005 | Tamura et al. | |
| 2005/0082747 | A1 | 4/2005 | Tamura et al. | |
| 2006/0022394 | A1 | 2/2006 | Tamura et al. | |
| 2006/0120783 | A1 * | 6/2006 | Tokita et al. | 399/407 |
| 2007/0052147 | A1 | 3/2007 | Tamura et al. | |
| 2007/0138726 | A1 | 6/2007 | Tamura et al. | |

FOREIGN PATENT DOCUMENTS

| | | | | |
|---|---|---|---|---|
| JP | 11060047 | * | 3/1999 | B65H 37/04 |
| JP | 3648356 | | 2/2005 | |
| JP | 2005254362 | * | 9/2005 | B26D 7/18 |
| JP | 4067299 | | 1/2008 | |

* cited by examiner

*Primary Examiner* — Blake A Tankersley

(74) *Attorney, Agent, or Firm* — Harness, Dickey & Pierce P.L.C.

(57) ABSTRACT

A punching device includes a punching unit that punches a hole in a sheet of paper; a container that receives a chad of paper generated upon punching by the punching unit; a dispersing member that is provided within the container and that is configured to disperse the chad of paper; and a guiding member configured to guide the chad of paper that is generated upon punching by the punching unit and fallen into the container to the dispersing member.

8 Claims, 19 Drawing Sheets

PUNCHING DEVICE, PAPER PROCESSING APPARATUS, AND IMAGE FORMING APPARATUS

CROSS-REFERENCE TO RELATED APPLICATIONS

The present application claims priority to and incorporates by reference the entire contents of Japanese Patent Application No. 2011-266064 filed in Japan on Dec. 5, 2011.

BACKGROUND OF THE INVENTION

1. Field of the Invention

The present invention relates to a punching device that punches a hole in a sheet of paper, a sheet processing apparatus and an image forming apparatus that include the punching device.

2. Description of the Related Art

In a general punching device that punches a hole in a sheet of paper, punch waste, which is a chad of paper generated upon punching, falls freely and is accumulated in a mountain form in a collection container collecting the punch waste. Thus, even when a top of the mountain of the accumulated punch waste reaches a height of the collection container, there remains space around peripheral walls of the collection container that are positioned farther from the top, which lowers the efficiency of collecting punch waste in the collection container. When the efficiency of collecting punch waste in the collection container is lowered, it becomes necessary to frequently dispose punch waste collected in the collection container, thereby deteriorating maintenance conditions.

In the punching device described in Japanese Patent No. 3648356, the collection container is provided therein with a guiding member that has shaft members fixed, at both ends thereof, to inner walls facing each other in the collection container, and roof-formed plate members provided substantially perpendicular to an axis direction of the shaft member and extended diagonally downward to both sides of the shaft member with the shaft member as a top line. With such a guiding member, punch waste falling onto one of inclined faces of the plate member and moving along the inclined face, punch waste falling onto the other inclined face of the plate member and moving along the inclined face, and punch waste falling not onto any of the inclined faces of the plate member, are dispersedly collected in the collection container. In this way, punch waste is dispersedly collected in the collection container by the guiding member, and a depositional surface of the punch waste accumulated in the collection container is a moderately inclined face in a substantially planer state. Thus, it is possible to substantially fill the collection container with punch waste while leaving little space, thereby improving the efficiency of collecting punch waste.

However, scattering directions of punch waste generated upon punching are varied, and thus when only a small amount of punch waste falls on the inclined faces of the plate member, the punch waste is not sufficiently dispersed in the collection container by the guiding member. Consequently, there occurs a problem in which the efficiency of collecting punch waste cannot be improved sufficiently.

Therefore, there is a need for a punching device capable of improving the efficiency of collecting a chad of paper to a collection container, as compared with the conventional punching device, a paper processing apparatus and an image forming apparatus that include the punching device.

SUMMARY OF THE INVENTION

According to an embodiment, there is provided a A punching device includes a punching unit that punches a hole in a sheet of paper; a container that receives a chad of paper generated upon punching by the punching unit; a dispersing member that is provided within the container and that is configured to disperse the chad of paper; and a guiding member configured to guide the chad of paper that is generated upon punching by the punching unit and fallen into the container to the dispersing member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
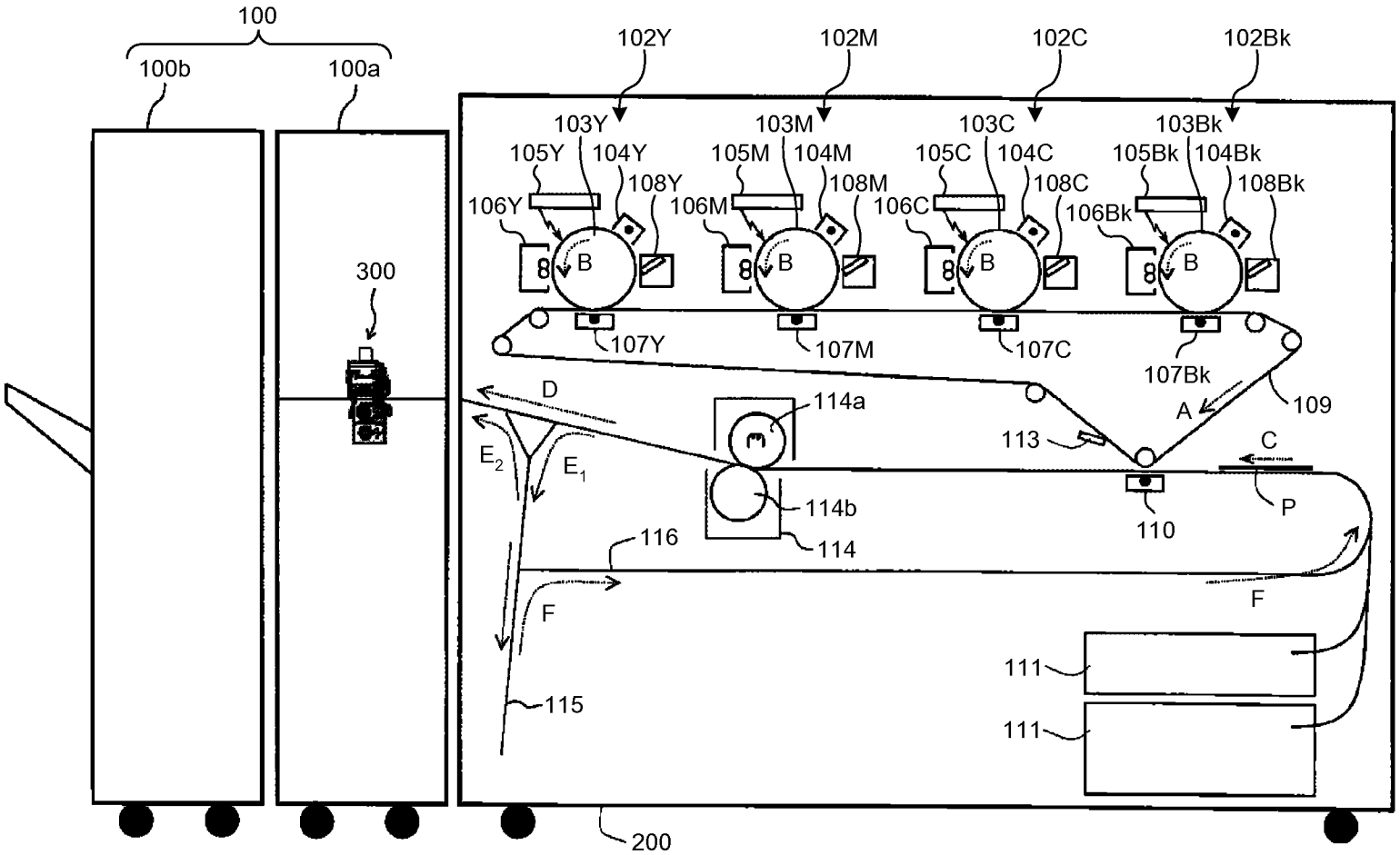
FIG. 1 is a schematic view of a copying system having an image forming apparatus, a punching device, and a paper processing apparatus according to an embodiment.

FIG. 1 is a schematic view of a copying system provided with an image forming apparatus 200 performing given processing on a sheet of paper, which is an example of an embodiment of the invention, and a paper processing apparatus 100 having a punching device 100*a* with a punching unit 300 and a finisher device 100*b*.

Figure 2:
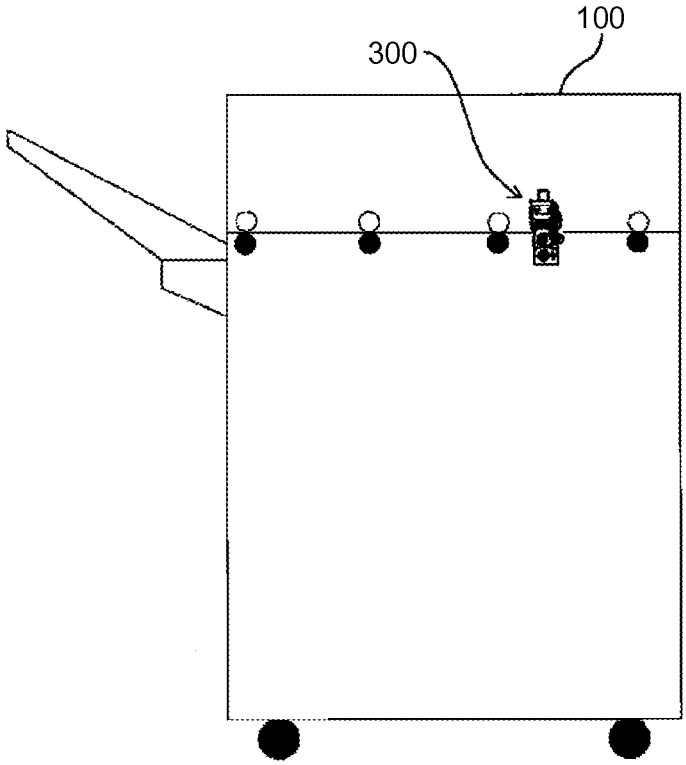
FIG. 2 is a schematic view of the paper processing apparatus having a punching unit.
Figure 3:
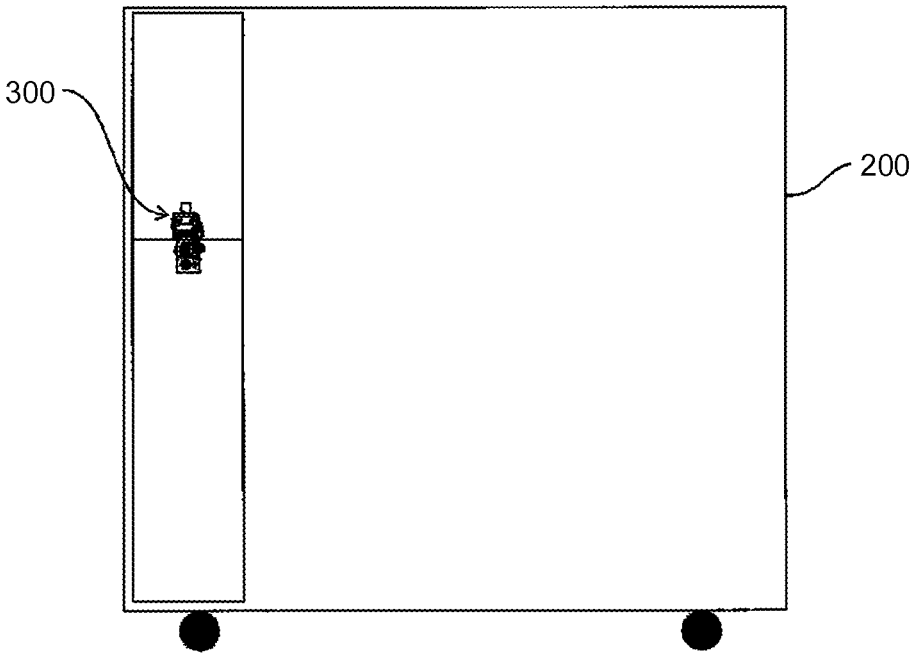
FIG. 3 is a schematic view of the image forming apparatus having the punching unit.
Figure 4:
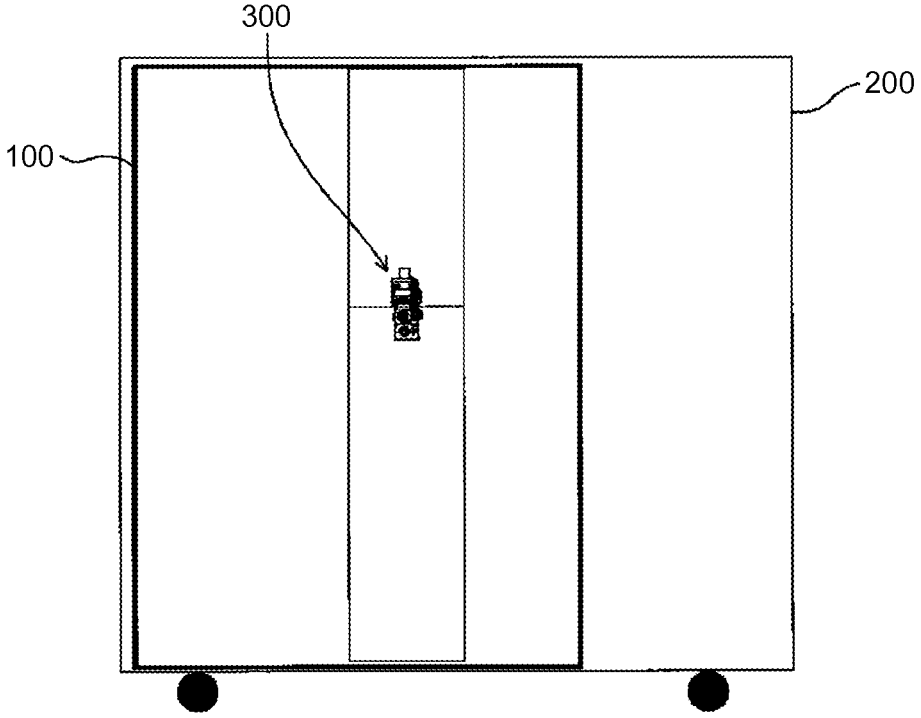
FIG. 4 is a schematic view of the image forming apparatus having the paper processing apparatus with the punching unit.

Note that the invention can be applied also to the paper processing apparatus 100 having the punching unit 300 as illustrated in FIG. 2, the image forming apparatus 200 having the punching unit 300 as illustrated in FIG. 3, and the image forming apparatus 200 having the paper processing apparatus 100 with the punching unit 300 as illustrated in FIG. 4, for example.

The image forming apparatus 200 has four image forming devices 102Y, 102M, 102C, and 102Bk corresponding to yellow (Y), magenta (M), cyan (C), and black (Bk), respectively, that are arranged along a running direction of an intermediate transfer belt 109. The image forming device 102Y is constituted by a photosensitive drum 103Y as an image carrier, a drum charger 104Y, an exposing unit 105Y, a developing unit 106Y, a transferring unit 107Y, a cleaning unit 108Y, etc. The image forming devices 102M, 102C, and 102Bk also have the same configuration as the image forming device 102Y. The image forming devices 102Y, 102M, 102C, and 102Bk form images with a color different one another. That is, the image forming device 102Y forms yellow images, the image forming device 102M forms magenta images, the image forming device 102C forms cyan images, and the image forming device 102Bk forms black images, for example.

Receiving signals for ordering the start of image forming operation from a control unit (not shown) of the image forming apparatus, the photosensitive drum 103Y starts to rotate in a direction of an arrow B in FIG. 1, and continues to rotate until the image forming operation is finished. Once the photosensitive drum 103Y starts to rotate, high voltage is applied on the drum charger 104Y, and the surface of the photosensitive drum 103Y is negatively charged in a uniform manner. When image data such as character data or graphic data that is converted into a dot image is transmitted, as signals turning on and off the exposing unit 105Y, to the exposing unit 105Y from the control unit (not shown) of the image forming apparatus, the exposing unit 105Y irradiates the surface of the photosensitive drum 103Y with laser light depending on the image data. Due to irradiation with laser light by the exposing unit 105Y, a portion where electric charge is decreased on the photosensitive drum 103Y becomes a latent image corresponding to the image data. Then, when the latent image reaches, with rotation of the photosensitive drum 103Y, a position facing the developing unit 106Y, negatively charged toner of the developing unit 106Y is drawn by the latent image, so that a toner image is formed on the photosensitive drum 103Y.

When the toner image formed on the photosensitive drum 103Y reaches, with rotation of the photosensitive drum 103Y, a position facing the transferring unit 107Y as a first transferring member, the toner image is transferred onto the intermediate transfer belt 109 rotating in a direction of an arrow A in FIG. 1 by action of high voltage applied on the transferring unit 107Y. Toner that is not transferred and remains on the photosensitive drum 103Y even after the toner image passes a transfer position (image transfer section) is removed from the photosensitive drum 103Y by the cleaning unit 108Y to prepare for the following image forming operation.

Following the image forming device 102Y, the image forming device 102M performs the image forming operation in the same manner. The toner image formed on a photosensitive drum 103M is transferred onto the intermediate transfer belt 109 by action of high voltage applied on a transferring unit 107M.

Here, the timing at which the image formed by the image forming device 102Y and transferred onto the intermediate transfer belt 109 reaches the transferring unit 107M is matched to the timing at which the toner image formed on the photosensitive drum 103M is transferred onto the intermediate transfer belt 109, whereby the toner images formed by the image forming device 102Y and the image forming device 102M are overlapped on the intermediate transfer belt 109. Similarly, the toner images formed by the image forming device 102C and the image forming device 102Bk are overlapped on the intermediate transfer belt 109. Thus, a full color image is formed on the intermediate transfer belt 109.

At the same time as the full color image reaches a paper transferring unit 110 as a second transferring member, paper P as a recording medium transferred in a direction of an arrow C of FIG. 1 from a paper feeding unit 111 of the image forming apparatus reaches the paper transferring unit 110, and the full color image on the intermediate transfer belt 109 is transferred onto the upper face of the paper P. The paper P with the full color image (unfixed toner image) formed thereon is conveyed to a fixing device 114 through a second transferring nip.

The fixing device 114 has a fixing roller 114*a*, and a pressing roller 114*b* pressed against the fixing roller 114*a*. The fixing roller 114*a* and the pressing roller 114*b* are in contact with each other, thus forming a fixing nip. The paper P is bound into the fixing nip. The fixing roller 114*a* has therein a heat source 114*c* as a heating unit, and the heat source 114*c* generates heat to heat the fixing roller 114*a*. The heated fixing roller 114*a* transfers heat to the paper P bound by the fixing nip to heat it. Due to the influence of such heating and nip pressure, the full color image on the paper P is fixed.

However, after the full color image passes the paper transferring unit 110, toner that is not transferred remains on the intermediate transfer belt 109. The remaining toner is removed from the intermediate transfer belt 109 by a belt cleaning device 113.

In the above description, the drive speed or the speed at which the paper P is conveyed of the photosensitive drum 103, the intermediate transfer belt 109, etc. is one determined for each image forming apparatus (hereinafter referred to as linear speed), and the unit of [mm/sec] is generally used as a moving distance for one second.

The paper P passing through the fixing device 114 is conveyed on a different path depending on a discharge mode. In case of single-sided printing, the paper P is discharged in a face-up state in which a side with the full color image fixed is a front face, or in a face-down state in which a side with the full color image fixed is a back face. In face-up discharge, the paper P passing through the fixing device 114 is conveyed as it is from the image forming apparatus 200 to the paper processing apparatus 100, as indicated by an arrow D in FIG. 1, and in face-down discharge, the paper P passing through the fixing device 114 is conveyed to a reversing unit 115 as indicated by an arrow $E_1$ in FIG. 1. Then, the paper P is reversed by the reversing unit 115, and conveyed from the image forming apparatus 200 to the paper processing apparatus 100 as indicated by an arrow $E_2$ in FIG. 1.

In case of duplex printing, the paper P passing through the fixing device 114 is conveyed to the reversing unit 115, and conveyed from the reversing unit 115 to a duplex conveying path 116 as indicated by an arrow F in FIG. 1, and then to the paper transferring unit 110 again. A full color image formed in the same manner as described above is transferred onto the paper P, and the paper P passes through the fixing device 114. The paper P passing through the fixing device 114 can be discharged in a face-up state, or a face-down state in which the paper P is reversed by the reversing unit 115, as described above.

Next, the paper processing apparatus 100 is described.

The paper processing apparatus 100 is fixed to the left side of the image forming apparatus 200. The paper processing apparatus has the punching device 100*a* that punches a hole in the paper P with an image formed thereon that is discharged from the image forming apparatus 200, and a finisher device 100*b* that stitches a plurality of sheets of paper P with an image formed thereon.

Figure 5:
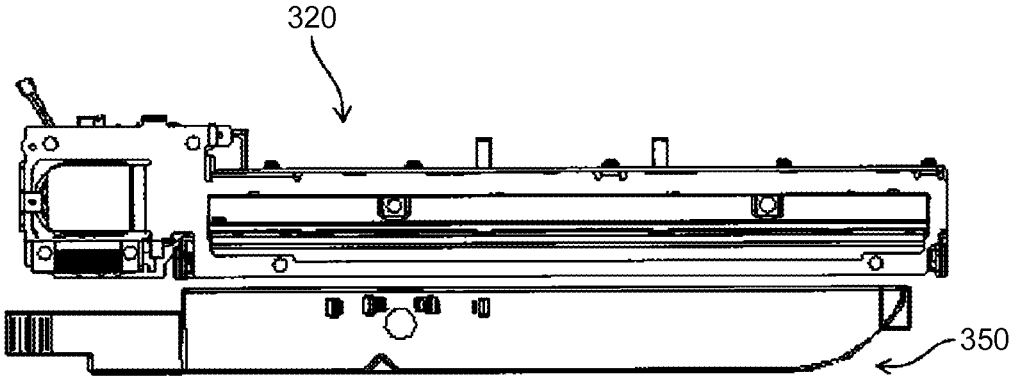
FIG. 5 is an outer lateral view of a puncher and a punch waste collection container that are provided in the punching unit for two-hole punching.
Figure 6:
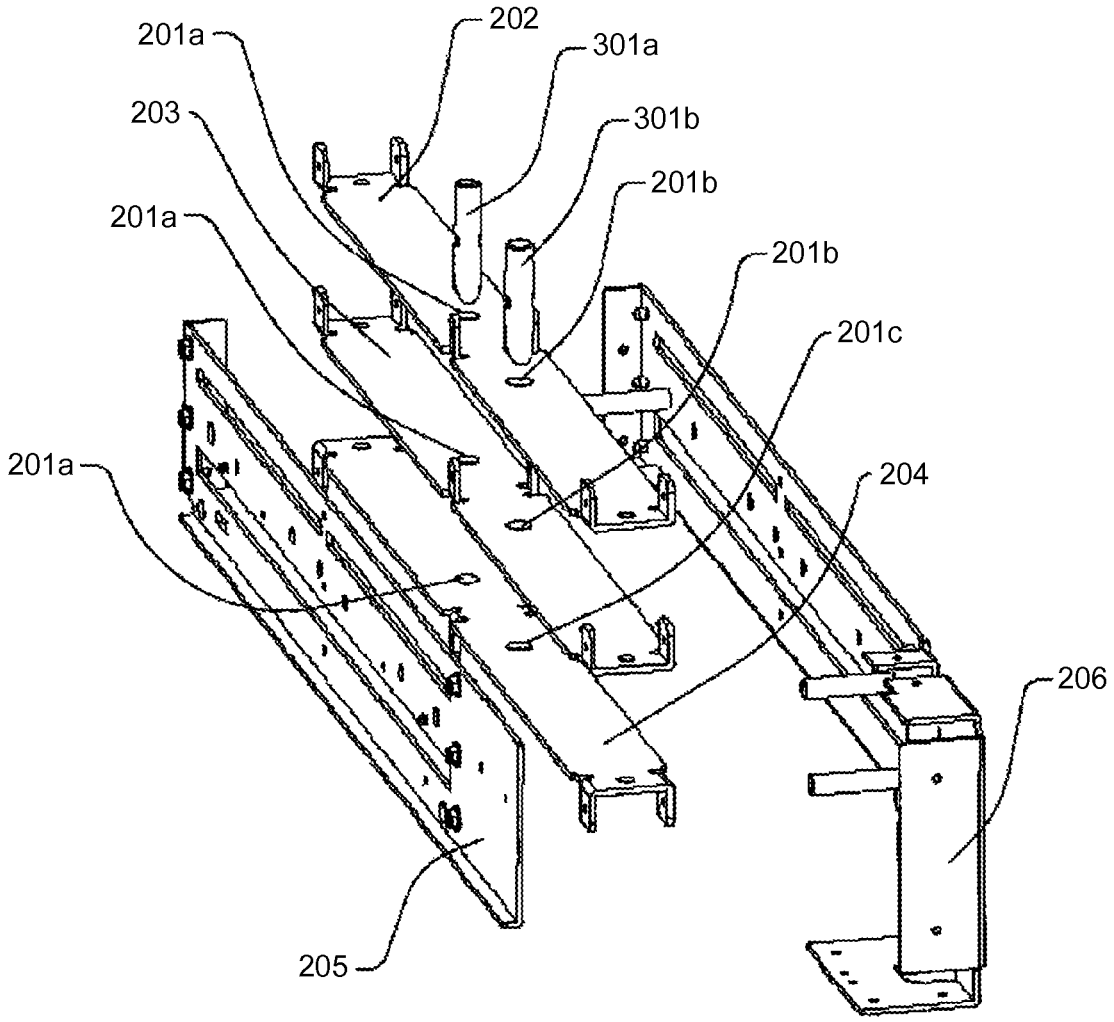
FIG. 6 is an exploded view of the puncher.

First, the configuration of the punching unit 300 provided in the punching device 100*a* is described by exemplifying a case of two-hole punching. FIG. 5 is an outer lateral view of a puncher 320 and a punch waste collection container 350 that are provided in the punching unit 300 for two-hole punching. FIG. 6 is an exploded view of the puncher 320.

As illustrated in FIG. 6, an upper guiding frame 202, a lower guiding frame 203, and a die frame 204 on each of which two die holes 201*a* and 201*b* are provided are fixed so that both of the side faces thereof are sandwiched between a right plate 205 and a left plate 206.

The two die holes 201*a* and 201*b* correspond to two punch pins 301*a* and 301*b*, respectively, and, with the reciprocating motion of the punch pins 301*a* and 301*b* relative to the die holes 201*a* and 201*b*, two holes are punched in the paper P at a given pitch.

Figure 7:
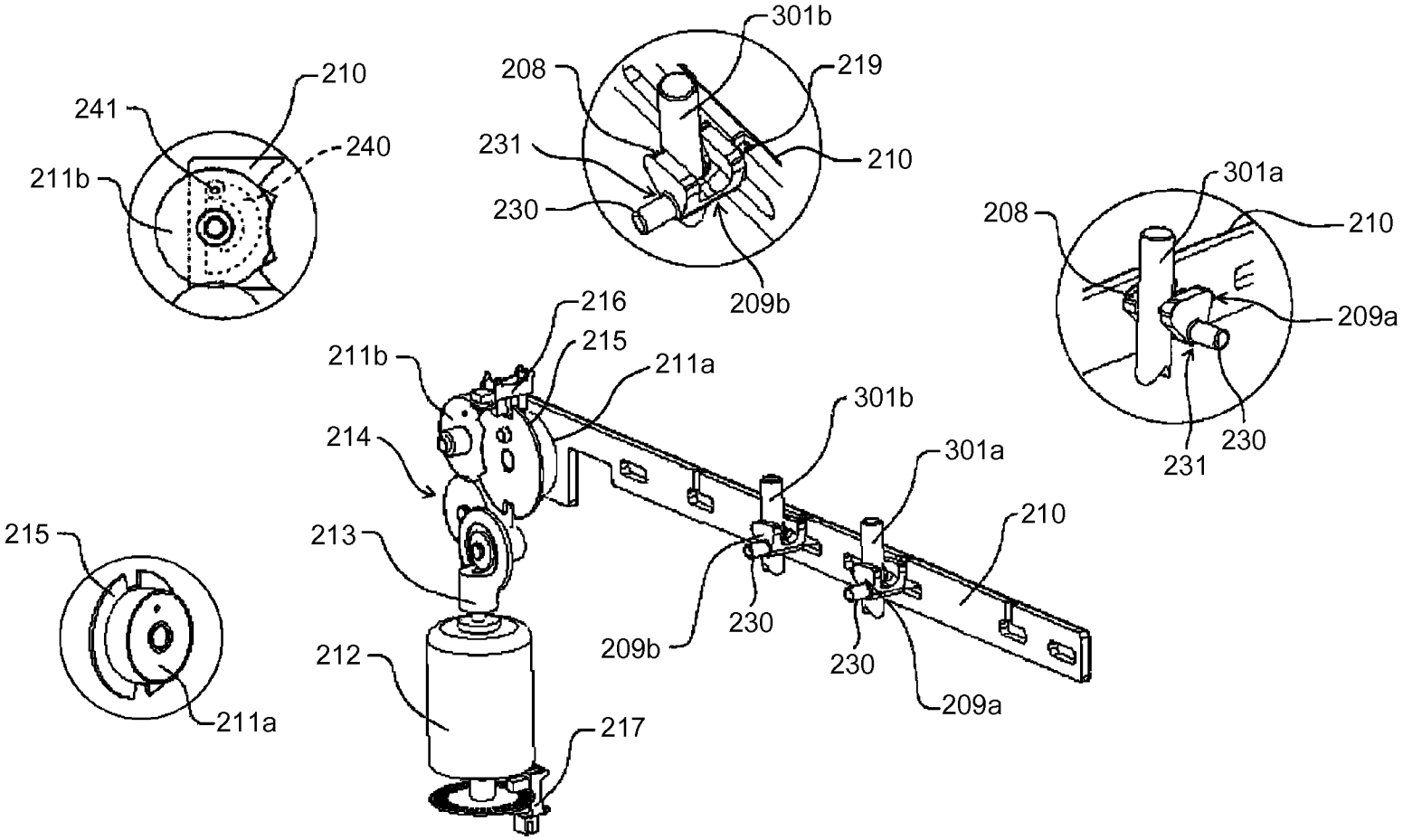
FIG. 7 is a schematic view of a drive mechanism of a punch pin.

As illustrated in FIG. 7, the punch pins 301*a* and 301*b* are supported by links 209*a* and 209*b*, respectively, through support pins 208. Rotating shafts 230 are inserted in through-holes 231 of the links 209*a* and 209*b*, and fulcrums provided at both ends of the rotating shafts 230 in axis directions are inserted into shaft holes provided on the right plate 205 and the left plate 206, and supported in a rotatable manner. Shaft-formed fulcrums 219 provided on the links 209*a* and 209*b* are connected to connected portions of a sliding arm 210. A D-formed groove 240 is formed on the sliding arm 210, and a convex portion 241 of a driving gear 211*b* is connected onto the groove 240.

A driving motor 212 is a DC brush motor, for example. The rotational driving force of the driving motor 212 is transmitted to the driving gears 211*a* and 211*b* through a reduction gear train 214 connected to a driving motor gear 213. The number of times of rotation (rotation amount) necessary for punching holes in the paper P is detected by a sensor filler 215 attached in an integrated or unified manner to the driving gear 211*b*, and a home position sensor 216. The driving motor 212 is controlled by the control unit (not shown) so as to have an appropriate rotation speed in accordance with the number of pulses detected by a pulse count sensor 217.

Figure 8:
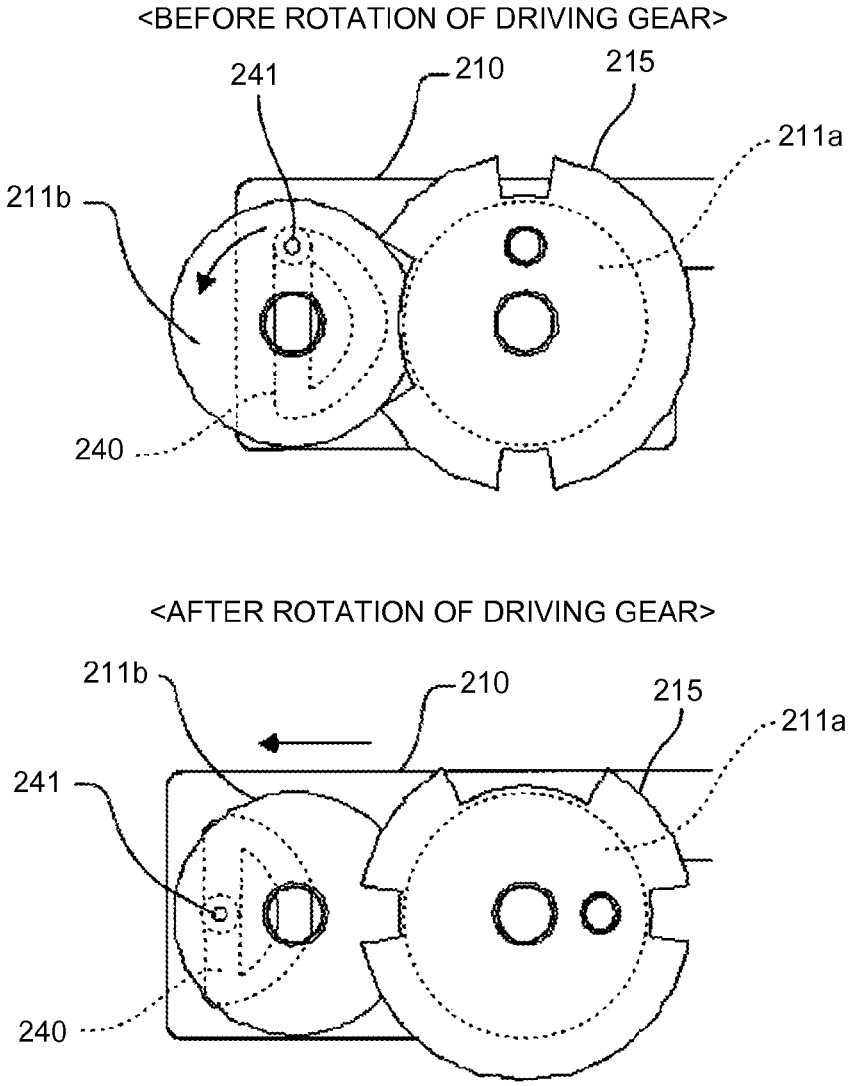
FIG. 8 is an explanatory view of an action of a driving gear in the drive mechanism of the punch pin.

An upper part of FIG. 8 illustrates a state in which the driving gears 211*a* and 211*b* are in their home positions.

When the driving gear 211*b* is rotated in a counterclockwise direction, the convex portion 241 of the driving gear 211*b* presses the linear section of the D-formed groove 240 on the sliding arm 210, so that the sliding arm 210 is reciprocated.

With the reciprocating motion of the sliding arm 210, the links 209*a* and 209*b* are rotated. Then, with the reciprocating motion of the punch pins 301*a* and 301*b*, two holes are punched in the paper P.

Figure 9:
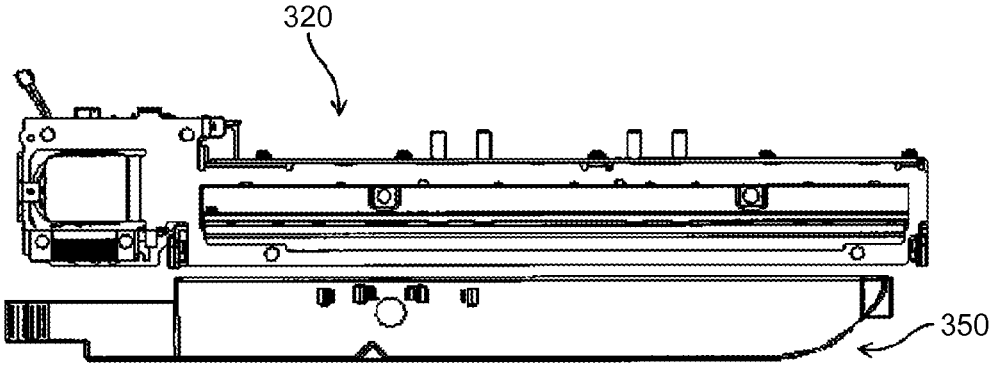
FIG. 9 is an outer lateral view of a puncher and a punch waste collection container that are provided in the punching unit for four-hole punching.

Here, FIG. 9 is an outer lateral view of the puncher 320 and the punch waste collection container 350 that are provided in the punching unit 300 for four-hole punching. Using the number of die holes, punch pins, support pins, and links corresponding to the number of holes to be punched, a plurality of holes can be punched in the same manner as described above.

Figure 10A:
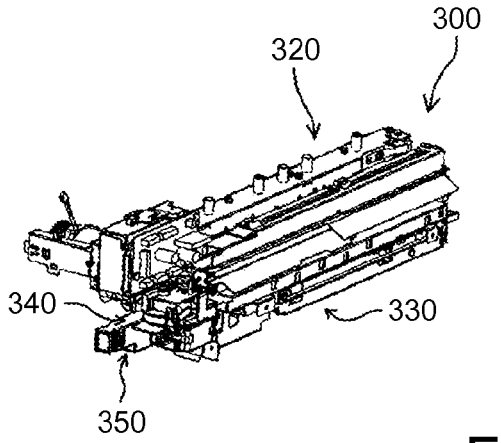
FIGS. 10A and 10B are outer perspective views of a punching unit capable of switching between two-hole punching and three-hole punching.
Figure 10B:
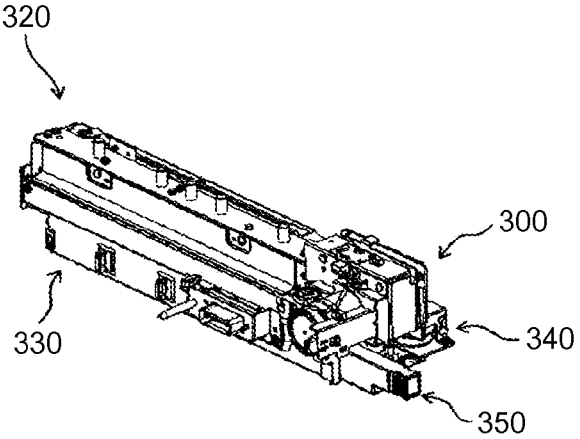
Figure 11:
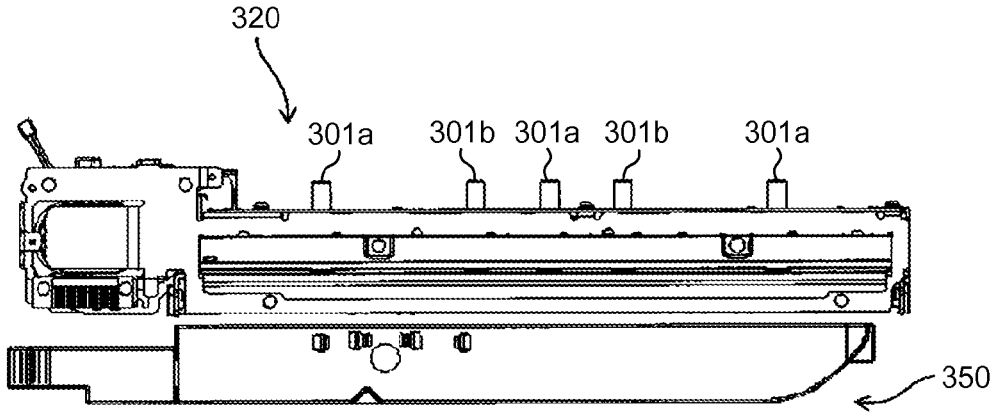
FIG. 11 is an outer lateral view of a puncher and a punch waste collection container that are provided in the punching unit capable of switching between two-hole punching and three-hole punching.

FIG. 10A is an outer front-side perspective view of the punching unit 300 capable of switching between two-hole punching and three-hole punching, and FIG. 10B is an outer back-side perspective view of the punching unit 300 capable of switching two-hole punching and three-hole punching. FIG. 11 is an outer lateral view of the puncher 320 and the punch waste collection container 350 that are provided in the punching unit 300 capable of switching between two-hole punching and three-hole punching.

Figure 12:
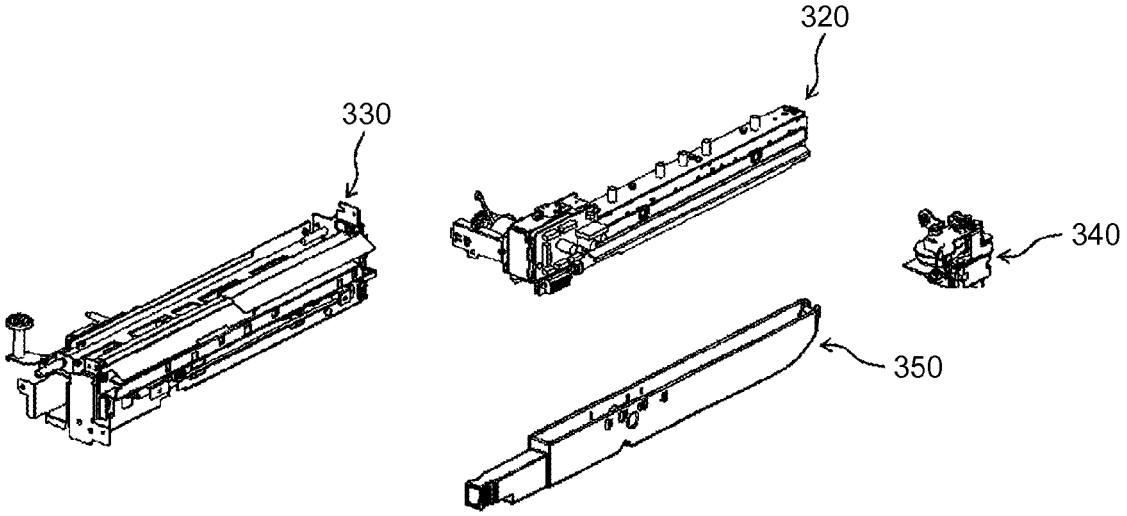
FIG. 12 is an exploded view of a punching unit.

In the punching unit 300, three punch pins 301*a* are used for three-hole punching, and two punch pins 301*b* are used for two-hole punching. As illustrated in FIG. 12, the punching unit 300 is constituted in combination of the punch waste collection container 350 that is a container for collecting punch waste, which is chads of paper generated when holes are punched in the paper P by the puncher 320, a moving unit 340 that moves the puncher 320, and a base unit 330 to which these are attached. On the base unit 330, the puncher 320 and the punch waste collection container 350 are attached so that the punch waste collection container 350 is positioned under the puncher 320.

Figure 13:
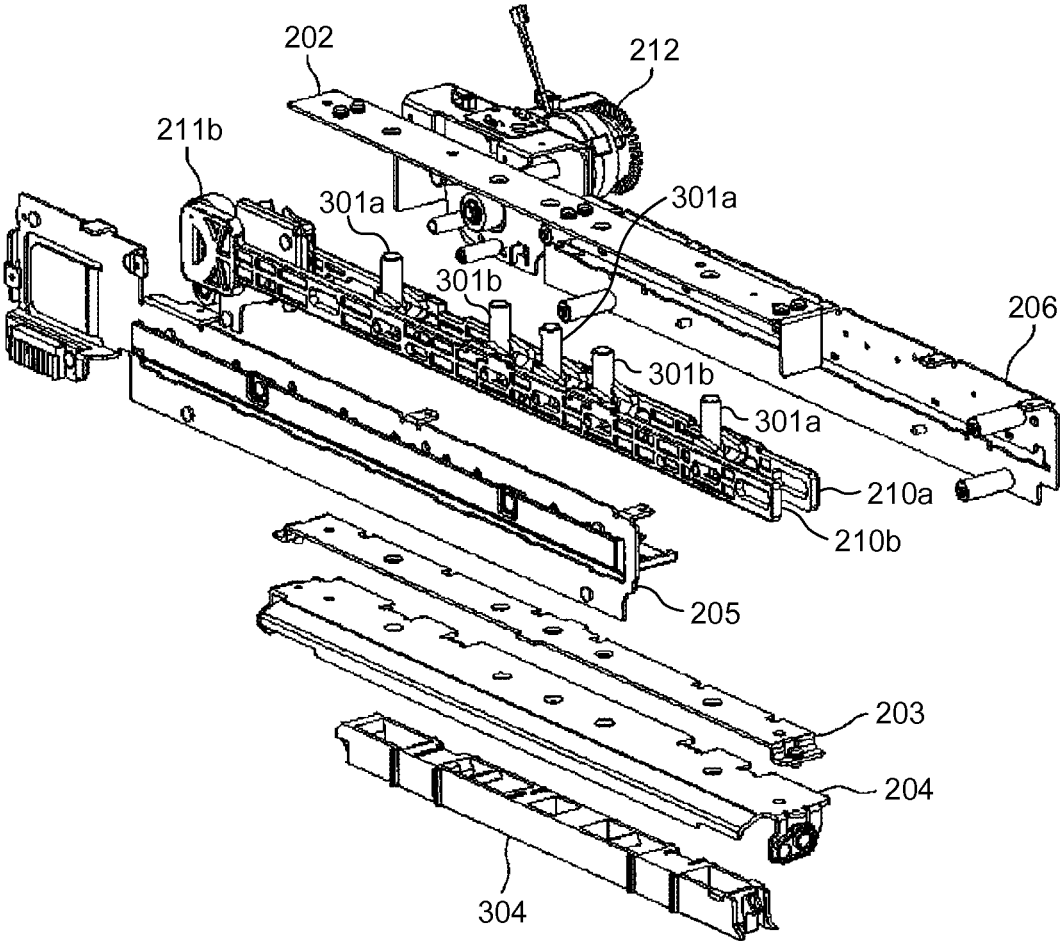
FIG. 13 is an exploded view of a puncher.
Figure 14:
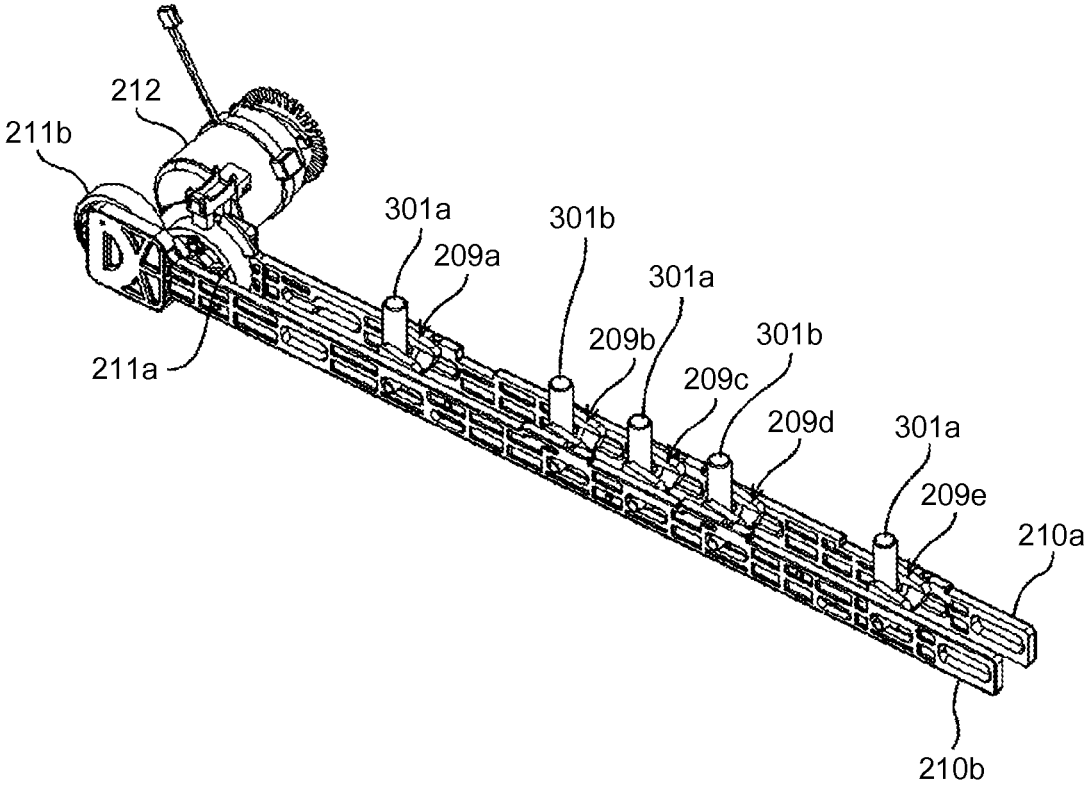
FIG. 14 is a perspective view of a drive mechanism that is provided in the puncher to move up and down the punch pin.
Figure 15A:
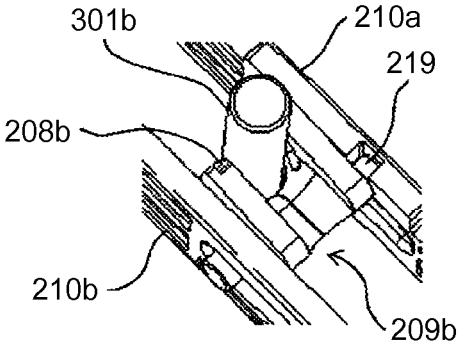
FIGS. 15A and 15B are enlarged views of the punch pin and the vicinity thereof.
Figure 15B:
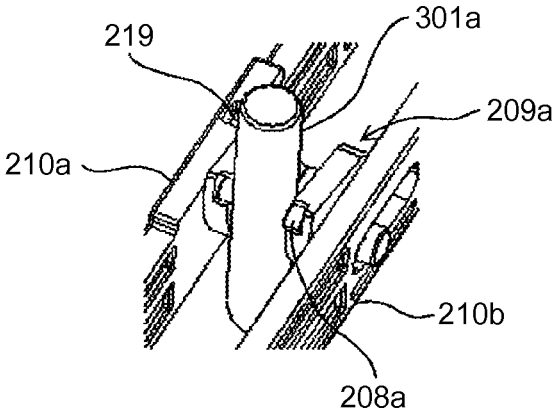

FIG. 13 is an exploded view of the puncher 320. FIG. 14 is a perspective view of a drive mechanism that is provided in the puncher 320 to move up and down the punch pins 301*a* and 301*b*. FIGS. 15A and 15B are enlarged views of the punch pins 301*a* and 301*b* and the vicinity thereof.

Figure 16:
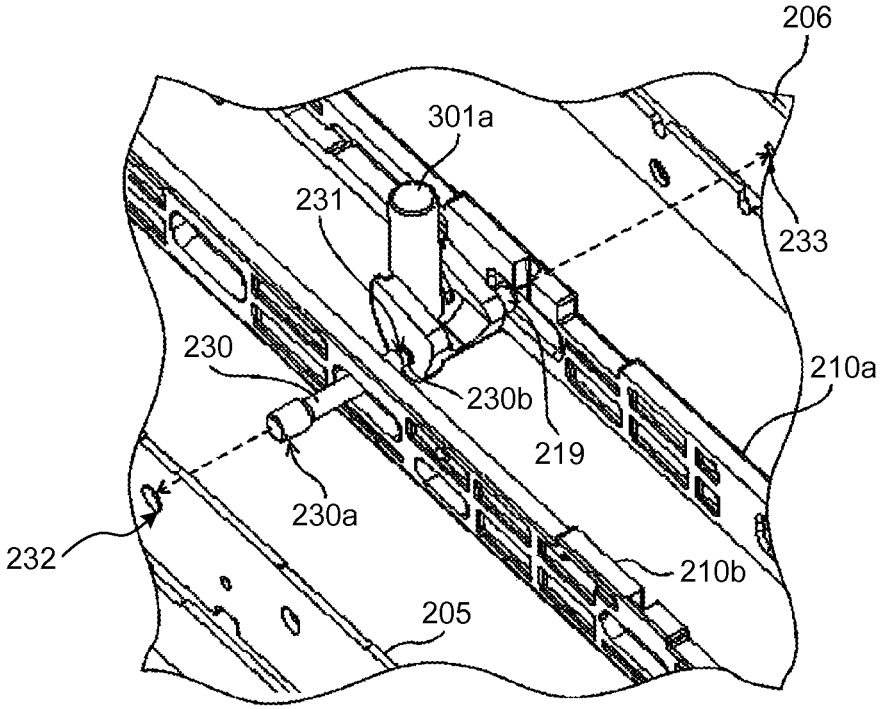
FIG. 16 is an exploded view of the puncher, in which the vicinity of the punch pin is enlarged.
Figure 17:
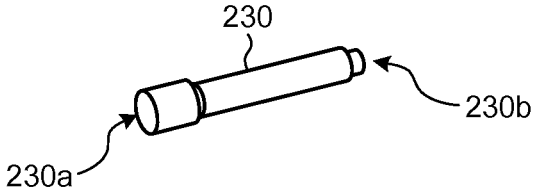
FIG. 17 is a perspective view of a rotating shaft inserted to a link.

As illustrated in FIGS. 15A and 15B, the punch pins 301*a* and 301*b* are supported by the links 209*a*, 209*b*, 209*c*, 209*d*, and 209*e* through the support pins 208*a* and 208*b*. As illustrated in FIG. 16, the rotating shaft 230 as illustrated in FIG. 17 is inserted in a through-hole 231 of each of the links 209*a*, 209*b*, 209*c*, 209*d*, and 209*e*, and fulcrums 230*a* and 230*b* provided at both ends of the rotating shaft 230 in an axis direction are inserted into shaft holes 232 and 233 provided on the right plate 205 and the left plate 206, respectively, and supported in a rotatable manner. Shaft-formed fulcrums 219 provided on the links 209*a*, 209*c*, 209*e* are connected to a connected portion of a sliding arm 210*a*. The shaft-formed fulcrums 219 provided on the links 209*b*, and 209*d* are connected to a connected portion of a sliding arm 210*b*.

Figure 18:
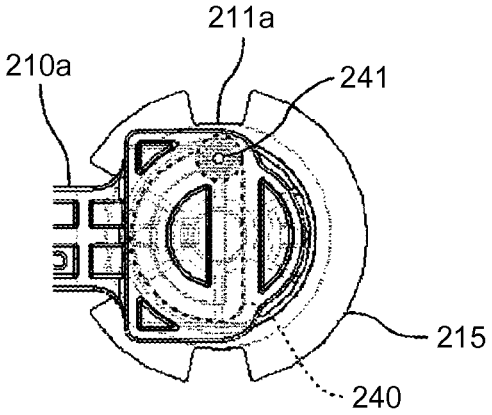
FIG. 18 is an enlarged view of a connected portion of a sliding arm and a driving gear.

As illustrated in FIG. 18, the D-formed groove 240 is formed on the sliding arm 210*a* at a connected portion with a driving gear 221*a*. The convex portion 241 of the driving gear 211*a* is inserted to the groove 240, so that they are connected to each other. Similarly, the D-formed groove 240 is formed on the sliding arm 210*b* at a connected portion with a driving gear 221*b*. The convex portion 241 of the driving gear 211*b* is inserted to the groove 240, so that they are connected to each other.

Figure 19:
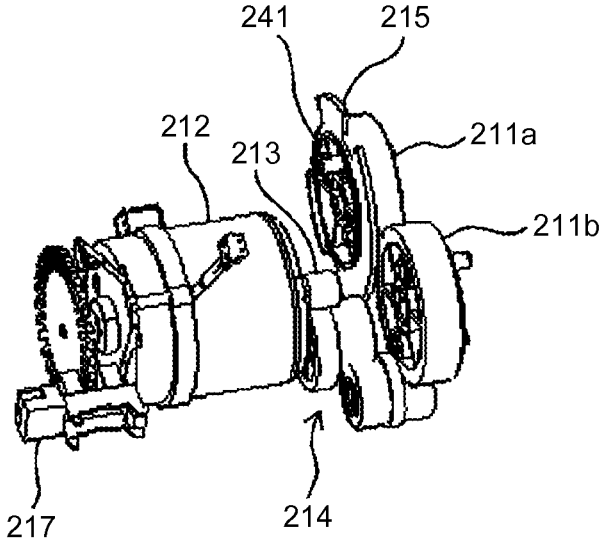
FIG. 19 is a perspective view of a driving motor and the periphery thereof.
Figure 20:
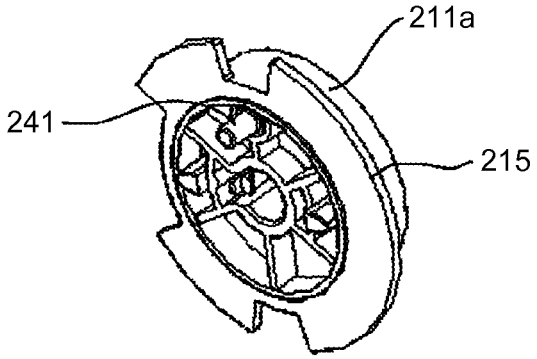
FIG. 20 is a perspective view of the driving gear to which a sensor filler is attached in an integrated or unified manner.

The driving motor 212 is a DC brush motor, for example. As illustrated in FIG. 19, the rotational driving force of the driving motor 212 is transmitted to the driving gear 211*a* or the driving gear 211*b* through the reduction gear train 214 connected to the driving motor gear 213. The number of times of rotation (rotation amount) necessary for punching holes in the paper P is detected by the sensor filler 215 attached in an integrated or unified manner to the driving gear 211*a*, and the home position sensor 216. The driving motor 212 is controlled by the control unit (not shown) so as to have an appropriate rotation speed in accordance with the number of pulses detected by the pulse count sensor 217.

FIG. 18 illustrates a state in which the driving gear 211*a* is in a home position. When the driving gear 211*a* is rotated in a counterclockwise direction of FIG. 18, the convex portion 241 of the driving gear 211*a* moves from the upper portion to the lower portion on the linear section of the groove 240 on the sliding arm 210*a* while pressing toward the right side of FIG. 18, so that the sliding arm 210*a* slides toward the right direction of FIG. 18. With the same mechanism, also the driving gear 211*b* can move the sliding arm 210*b*.

Figure 21:
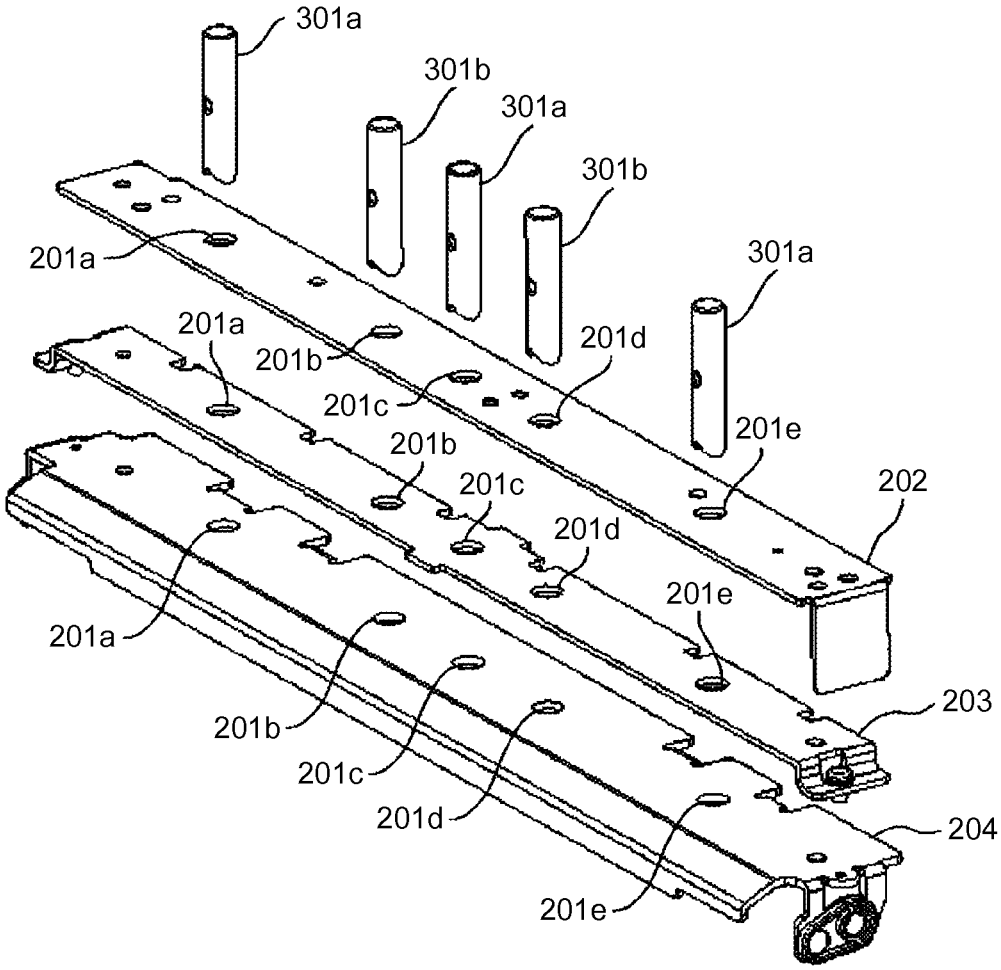
FIG. 21 is an explanatory view of various members of the punching unit on which die holes through each of which the punch pin passes are provided.

As illustrated in FIG. 21, the puncher 320 has the upper guiding frame 202, the lower guiding frame 203, and the die frame 204 on each of which the die holes 201*a*, 201*b*, 201*c*, 201*d*, and 201*e* are provided corresponding to the punch pins 301*a* and 301*b*. With the reciprocating motion in a vertical direction of the punch pins 301*a* and 301*b* passing through the die holes 201 opened on the upper guiding frame 202, the lower guiding frame 203, and the die frame 204, a plurality of holes can be punched in the paper P at a given pitch.

Figure 22:
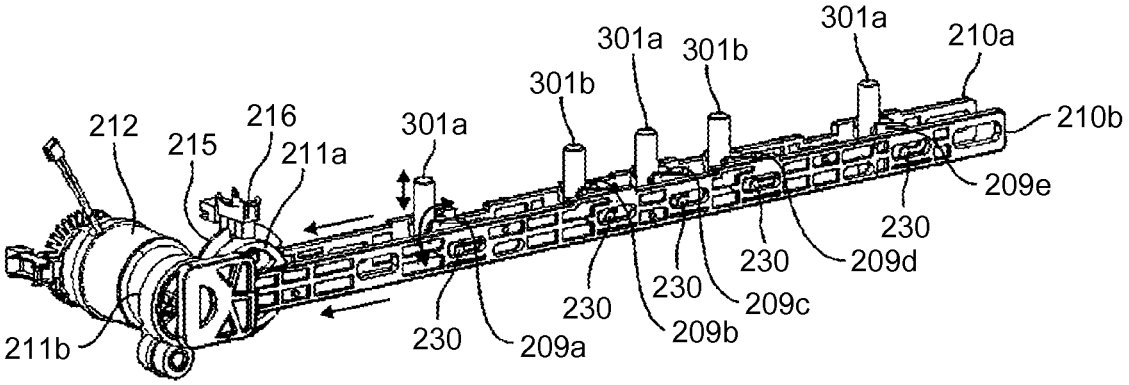
FIG. 22 is an explanatory view of an action of the drive mechanism in punching operation.

FIG. 22 is an explanatory view of an action of a drive mechanism in punching operation.

When the driving motor 212 rotates the driving gear 211*a* (driving gear 211*b*), the rotation of the driving gear 211*a* (driving gear 211*b*) slides the sliding arms 210*a* and 210*b* connected to the respective driving gears 211 to a direction of arrows in FIG. 22. The sliding of the sliding arms 210*a* and 210*b* rotates the links 209 connected to the respective sliding arms 210*a* and 210*b*. Then, the punch pins 301*a* and 301*b* connected to the respective links 209 move up and down, thereby performing punching operation for punching holes in the paper P.

Figure 23:
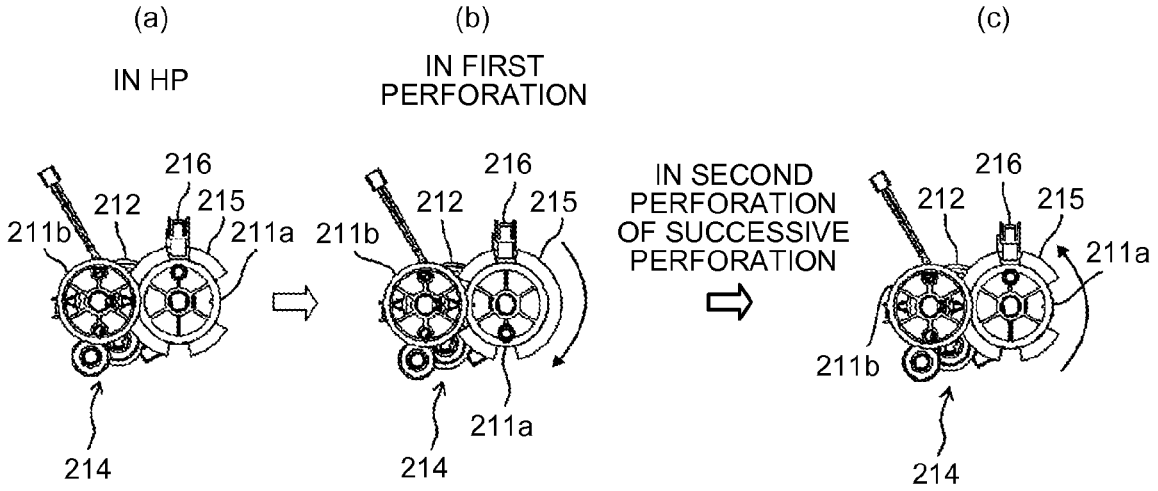
FIG. 23 is a diagram illustrating a state (a) in which the driving gear is in a posture of a home position, a state (b) in which the driving gear is rotated by 180° from the home position, and a state (c) in which the driving gear is returned to be in a posture of the home position.

When punching operation is performed once, the driving gears 211*a* and 211*b* are rotated by 180°. For example, the driving gear 211*a* in a posture of a home position, as illustrated in the state (a) of FIG. 23, is rotated by 180° in a clockwise direction by the driving motor 212 as illustrated in the state (b) of FIG. 23, which reciprocates the punch pins 301*a* in a vertical direction once to perform one-time punching operation. When the punching operation is performed two or more times successively, after the punching operation is performed once, the driving gear 221*a* in the posture as illustrated in the state (b) of FIG. 23 is rotated by 180° in a counterclockwise direction so as to be in the posture of the home position as illustrated in the state (c) of FIG. 23. Thus, the punch pins 301*a* are reciprocated once in a vertical direction to perform the second punching operation. For the third or the following punching operation, the driving gear 211*a* is rotated repeatedly in a clockwise direction and a counterclockwise direction of FIG. 23. This allows successive punching operation.

Figure 24:
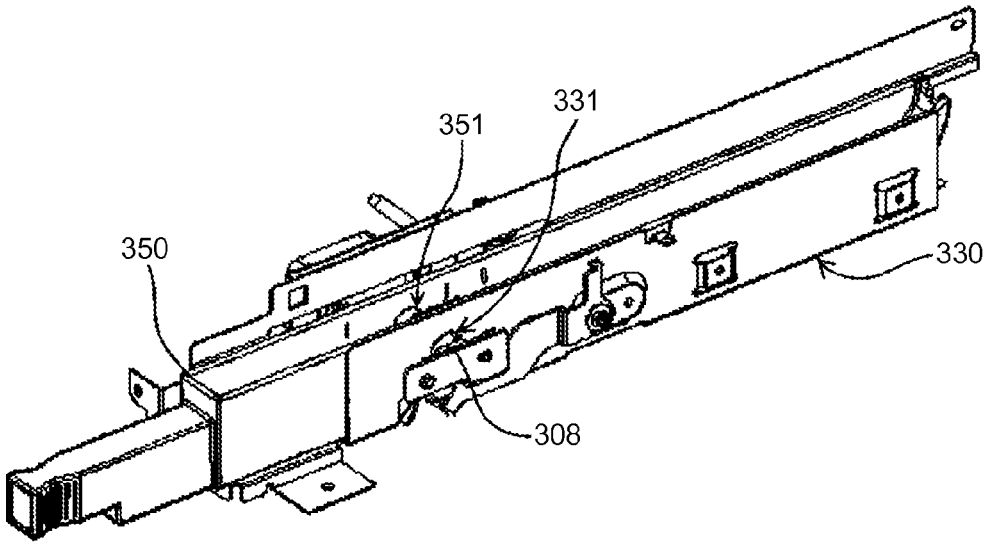
FIG. 24 is a perspective view of a base unit viewed from the side on which a full-state detecting unit is provided.

As illustrated in FIG. 24, the base unit 330 is provided with a full-state detecting unit 308 detecting that a punch waste collection container 305 is filled with punch waste when the punch waste collected and accumulated in the waste collection container 305 reaches a given height. As the full-state detecting unit 308, a reflecting optical sensor can be used, for example.

Figure 25:
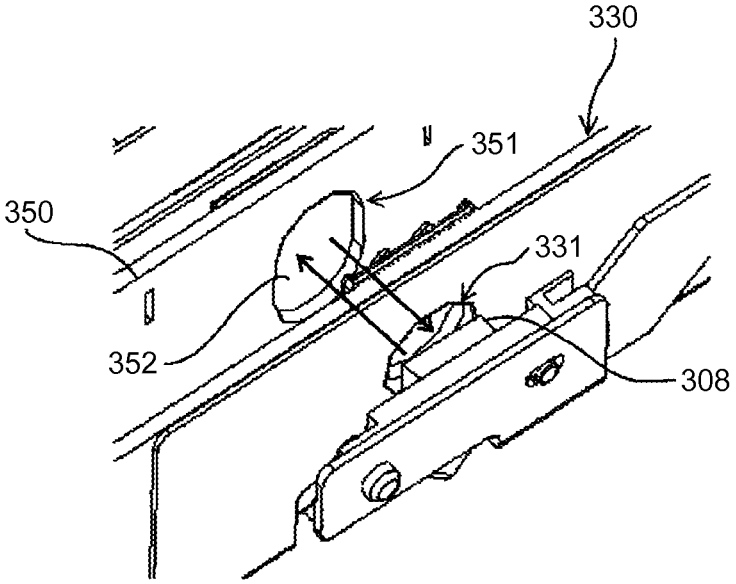
FIG. 25 is an enlarged view of the full-state detecting unit and the vicinity thereof.

As illustrated in FIG. 25, the reflecting optical sensor irradiates the inside of the punch waste collection container 350 with light through a punch waste detection hole 331 formed on the side wall of the base unit 330, and a punch waste detection hole 351 formed on the side wall of the punch waste collection container 350 so as to correspond to the punch waste detection hole 331.

The punch waste detection hole 351 formed on the punch waste collection container 350 is covered by a diffuse reflection sheet 352. The diffuse reflection sheet 352 makes light from the reflecting optical sensor pass into the punch waste collection container 350, while it makes a part of light reflected on the surface of the diffuse reflection sheet 352 reflect diffusely. Thus, when punch waste accumulated does not reach the height of the punch waste detection hole 351, light from the reflecting optical sensor that passes through the diffuse reflection sheet 352 is not reflected, and reflected light that is reflected on the diffuse reflection sheet 352 is also reflected diffusely. Consequently, the reflecting optical sensor does not detect light, that is, the reflecting optical sensor does not detect that the punch waste collection container 350 is filled with punch waste.

However, when punch waste is accumulated and reaches the height of the punch waste detection hole 351, light from the reflecting optical sensor that passes through the diffuse reflection sheet 352 is reflected by punch waste, and detected by the reflecting optical sensor. That is, the reflecting optical sensor detects that the punch waste collection container 350 is filled with punch waste.

Figure 26:
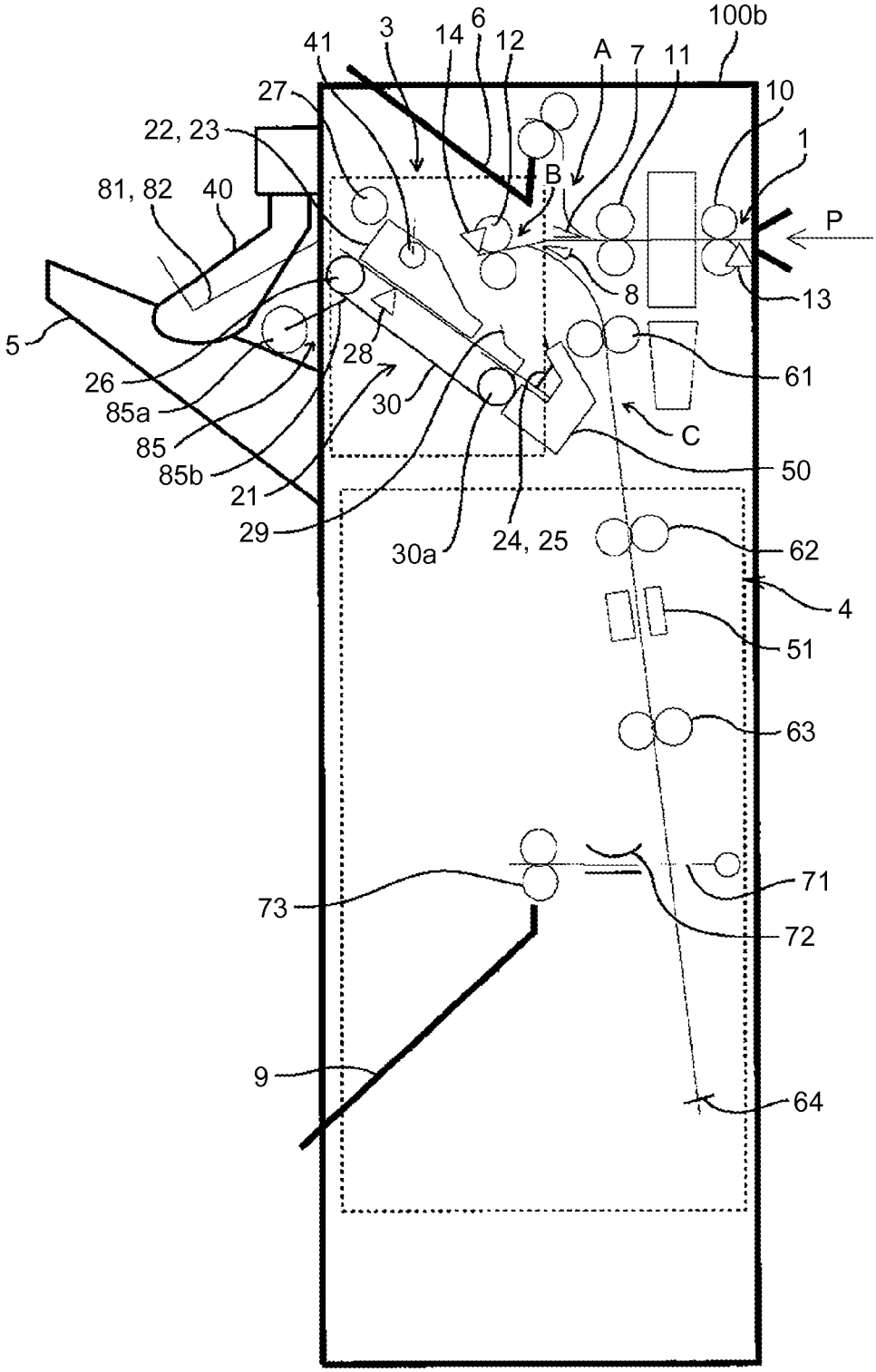
FIG. 26 is a schematic configuration view of a finisher device.

FIG. 26 is a schematic configuration view of the finisher device 100*b* of the paper processing apparatus 100.

The finisher device 100*b* has an introduction path 1 that receives the paper P already subjected to punching operation by the punching device 100*a*, or the paper P conveyed without being subjected to punching operation by the punching device 100*a*. The introduction path 1 separates to three paths of an upper conveying path A toward a proof tray 6, a straight conveying path B toward an edge stitching unit 3 that performs shift processing, edge stitching, and two-position stitch, and a lower conveying path C toward a saddle stitching unit 4 that performs saddle stitching.

An entrance roller 10 and an entrance sensor 13 are arranged on the introduction path 1, and the fact that the paper P is conveyed into the finisher device 100*b* is detected by the entrance sensor 13. In the downstream of the entrance roller 10, a first carriage roller 11 is arranged. In addition to the first carriage roller 11, a first bifurcating claw 7, a second bifurcating claw 8, etc. are also provided on the introduction path 1. A second carriage roller 12 is arranged on the straight conveying path B in the downstream in a sheet conveying direction of the second bifurcating claw 8. When a tip of the first bifurcating claw 7 is on the upper conveying path A, the paper P is conveyed to the straight conveying path B. When the tip of the first bifurcating claw 7 is on the introduction path 1, the paper P is conveyed to the upper conveying path A.

In order to convey the paper P from the introduction path 1 to the lower conveying path C, the rotation of the second carriage roller 12 is stopped once the trailing end of the paper P passes through the second bifurcating claw 8, and the tip of the second bifurcating claw 8 is positioned on the introduction path 1. Concretely, paper size information is received from the image forming apparatus 200 and, based on the received paper size information, time required until the trailing end of the paper P passes through the second bifurcating claw from the detection of the leading end of the paper P by a paper leading end detection sensor 14 provided in the downstream end of the straight conveying path B, is calculated. Once the calculated time has passed since the paper leading end detection sensor 14 detects the leading end of the paper P, the rotation of the second carriage roller 12 is stopped, and the tip of the second bifurcating claw 8 is positioned on the introduction path 1. When the tip position of the second bifurcating claw 8 is shifted, the second carriage roller 12 is rotated reversely, and the paper P is switched back and conveyed to the lower conveying path C.

A staple tray 21 as a carrying unit is provided at a diagonally lower position from the second carriage roller 12 and arranged in the downstream of the straight conveying path B. The paper P is discharged from the straight conveying path B onto the staple tray 21.

The paper carrying face of the staple tray 21 is inclined so as to be vertically upward on the paper discharge side. At the left end of the staple tray 21 in FIG. 26, a discharging roller 26 and a discharging sensor 28 are arranged, and a discharge port from the finisher device 100*b* to a discharge tray 5 is provided.

The discharging roller 26, and a driven roller 27 that can be brought into contact with or separate from the discharging roller 26 have a pair configuration, and sandwich the paper P on the staple tray 21 therebetween to discharge it onto the discharge tray 5. With the pair configuration, it is possible, by displacing a discharging guide (not shown) supporting the driven roller 27, to select a closed state in which the paper P is sandwiched between the discharging roller 26 and the driven roller 27 to discharge it, or an open state in which the paper P is not sandwiched between the discharging roller 26 and the driven roller 27.

Moreover, the finisher device 100*b* has a shift mechanism that moves the second carriage roller 12 in a sheet width direction (direction orthogonal to a paper face). In a classification mode, the shift mechanism moves the second carriage roller 12 that is conveying sheets in a sheet width direction by a specific amount, so that the paper P is shifted in a sheet width direction by the specific amount, and discharged onto the discharge tray 5 by the discharging roller 26.

A discharged paper backing mechanism 85 is provided, above the discharge tray 5, as a unit striking the upper face of the paper discharged onto the discharge tray 5 by pendular movement to back the paper up to the side of the device. The discharged paper backing mechanism 85 is constituted by a discharged paper arm 85*b* supported by the device in a rockable manner, a discharged paper backing roller 85*a* supported at the tip of the discharged paper arm 85*b* in a rotatable manner, and a rocking unit (not shown) rocking the discharged paper arm 85*b*.

A pair of discharged paper jogger fences 81 and 82 are attached movably in the up and down directions above the discharge tray 5 on the discharging side face of the device (left side face in FIG. 26).

In a classification mode, once the paper P is discharged onto the discharge tray 5, the paper P is adjusted regarding the position in a width direction by the discharged paper jogger fences 81 and 82. The discharged paper backing roller 85*a* is moved in a pendular manner to strike the upper face of the paper, thus facilitating the movement of the paper P, with self-weight, toward a reference fence (not shown) provided on the device side of the discharge tray 5. Then, the end of the paper is brought into contact with the reference fence (not shown), and the paper P is thus adjusted regarding the position in a longitudinal direction. Once a given number of pieces of paper P is discharged onto the discharge tray 5, the bundle of pieces of paper P is adjusted by the discharged paper jogger fences 81 and 82, and the discharged paper backing roller. Then, the discharged paper jogger fences 81 and 82 are moved upward and shifted in a sheet width direction by a given amount, and the shift mechanism moves the second carriage roller 12 by a specific amount. The pieces of paper P constituting the following paper bundle are being accumulated at a position deviated in a sheet width direction on the discharge tray 5. Subsequently, the paper bundles are adjusted by the discharged paper jogger fences 81 and 82, and the discharged paper backing roller 85*a*, in the same manner as described above.

A discharged paper filler 40 is provided in the vicinity of the upper portion of the discharge port. The discharged paper filler 40 is arranged in a rotatable manner near the center of the paper P stacked on the discharge tray 5, and the tip of the discharged paper filler 40 is in contact with the upper face of the paper P.

An upper face detection sensor (not shown) detecting a height position of the tip of the discharged paper filler 40 is provided near the base of the discharged paper filler 40. These components detect a height of the paper face of the paper P on the discharge tray 5. As the upper face detection sensor, a transmission type optical sensor can be used, for example. When there is no paper P on the discharge tray 5, the discharged paper filler 40 is positioned between a light-emitting element and a light-receiving element of the upper face detection sensor, and the output of the upper face detection sensor is off.

As the height of the paper bundle increases with the increase of the number of pieces of paper accumulated on the discharge tray 5, the discharged paper filler 40 rotates in a clockwise direction in FIG. 26. Thus, the discharged paper filler 40 gets out from in between the light-emitting element and the light-receiving element of the upper face detection sensor, and the output of the upper face detection sensor is turned on. Then, the control unit (not shown) controls a driving unit (not shown) that moves the discharge tray 5 vertically, so as to move the discharge tray 5 down. When the discharge tray 5 is moved down, the discharged paper filler 40 rotates in a counterclockwise direction in FIG. 26. Thus, the discharged paper filler 40 becomes positioned again between the light-emitting element and the light-receiving element of the upper face detection sensor, and blocks light of the light-emitting element, so that the upper face detection sensor is turned off. Once the upper face detection sensor is turned off, the discharge tray 5 is stopped moving down. When such operation is repeated, and the height of the discharge tray 5 reaches a predetermined height of tray full-state, the finisher device 100*b* outputs stop signals to the image forming apparatus 200 to stop image forming operation of the system.

The staple tray 21 is provided with a stapler 50, which is a stitching unit as a post-processing unit divided to a driver and a clincher that move forward and backward in a direction orthogonal to the paper face. The staple tray 21 is provided with a pair of stapling jogger fences 22 and 23 arranged in a paper width direction movable in a paper width direction, to adjust the position of accumulated pieces of paper P regarding the width direction. Furthermore, the staple tray 21 is provided with two edge stitching reference fences 24 and 25 aligned in a paper width direction to adjust the position of the accumulated pieces of paper P regarding the longitudinal direction (paper conveying direction) in a manner that the leading end of the paper is brought into contact with the edge stitching reference fences 24 and 25.

A stapling backing roller 41 striking the upper face of the paper by pendular movement is provided above the staple tray 21. Moreover, the staple tray 21 is provided with an ejecting belt 30. The ejecting belt 30 is extended between the discharging roller 26, and a driven roller 30*a* provided on the stapler side.

In the edge stitching mode, the driven roller 27 is spaced from the discharging roller 26, and the operation of the discharging roller 26 (ejecting belt 30) is stopped. The paper carrying face of the staple tray 21 is inclined so that the edge stitching reference fences 24 and 25 are on the lower sides. Thus, the paper P conveyed to the staple tray 21 is moved, with self-weight, to the sides of the edge stitching reference fences 24 and 25. Furthermore, the stapling backing roller 41 strikes the paper P on the staple tray 21 toward the edge stitching reference fences 24 and 25, thus facilitating the movement of the paper P, with self-weight, to the side of the edge stitching reference fences 24 and 25. In this manner, with the self-weight of the paper and the stapling backing roller 41, the paper P is moved to the side of the edge stitching reference fences 24 and 25, and stopped when the end of the paper is brought into contact with the edge stitching reference fences 24 and 25.

That is, in the embodiment, the configuration in which the edge stitching reference fences 24 and 25 are on the lower side of the paper carrying face of the staple tray 21, and the stapling backing roller 41 constitute a paper movement mechanism. When the paper P is moved to the side of the edge stitching reference fences 24 and 25, the stapling jogger fences 22 and 23 are driven to adjust the position of the paper P in a width direction.

The paper bundle of a given number of pieces of paper P accumulated on the staple tray 21 (ejecting belt 30) is subjected to edge stitching by the stapler 50. The stapler 50 is moved in a paper width direction to staple the paper bundle at an appropriate position of the lower edge thereof, as edge stitching.

Once the edge stitching is completed, the discharging roller 26 is driven to rotate, and the ejecting belt 30 is moved endlessly. The ejecting belt 30 is provided with an ejecting claw 29 projecting on the circumference of the ejecting belt. When the ejecting belt 30 is rotated in a counterclockwise direction in FIG. 26, the ejecting claw 29 is brought into contact with the end (lower edge) of the paper bundle that is already subjected to stitching. Then, the ejecting belt 30 is further moved endlessly, so that the ejecting claw 29 brings up the paper bundle.

Moreover, the driven roller 27 is moved downward, and the discharging roller 26 and the driven roller 27 sandwiches the paper P, thereby discharging the paper P onto the discharge tray 5. That is, in the embodiment, the discharging unit is constituted by the ejecting belt 30, the ejecting claw 29, etc.

In the saddle stitching unit 4, saddle stitching carriage rollers 61, 62, and 63, and a saddle stitching stapler 51 are arranged along the lower conveying path C. The paper P introduced from the introduction path 1 to the lower conveying path C is conveyed to a saddle stitching position by the saddle stitching carriage rollers 61, 62, and 63, brought into contact with a saddle stitching reference fence (not shown), and then stacked. Once a given number of pieces of paper P is stacked at the saddle stitching position, the paper bundle of pieces of paper P is subjected to adjustment processing by a saddle stitching jogger fence (not shown), etc. and then to stitching at the middle of the paper bulk by the saddle stitching stapler 51.

Next, the saddle stitching reference fence (not shown) is opened. After that, the paper bundle that is already subjected to saddle stitching is conveyed to a paper folding stopper 64 in the saddle stitching unit 4 by the saddle stitching carriage rollers 62 and 63, and folded in the middle by a paper folding blade 71 and a paper folding plate 72. Then, the folded paper bundle is discharged onto a saddle stitching tray 9 by a folded paper discharging roller 73.

Configuration 1

Next, the punching unit 300 of the punching device 100*a*, which is a characteristic of Configuration 1, is described.

Figure 27:
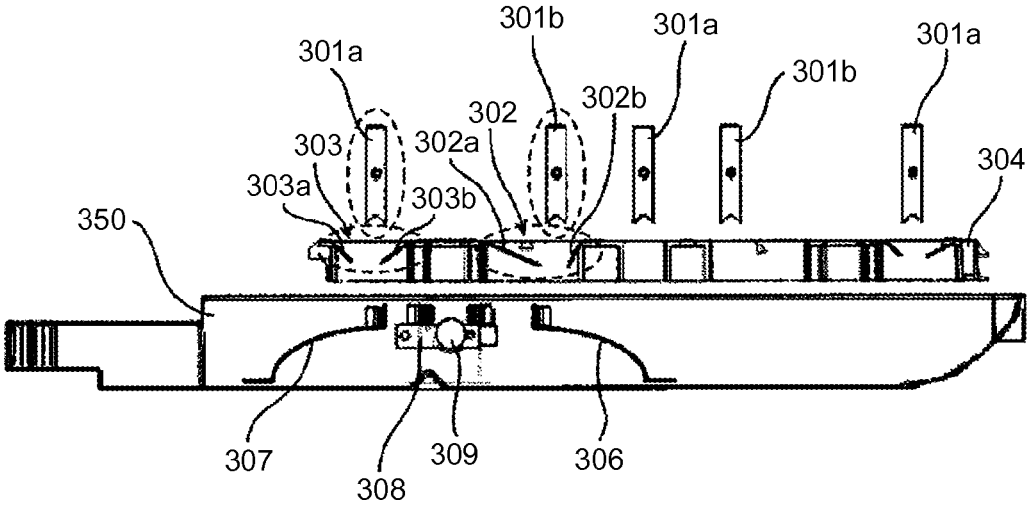
FIG. 27 is a sectional view of the punching unit provided with a member restricting dispersing directions of punch waste.

FIG. 27 is a schematic view of the punching unit 300 capable of switching between two-hole punching and three-hole punching. The three punch pins 301*a* are used for three-hole punching, while the two punch pins 301*b* are used for two-hole punching.

Figure 28:
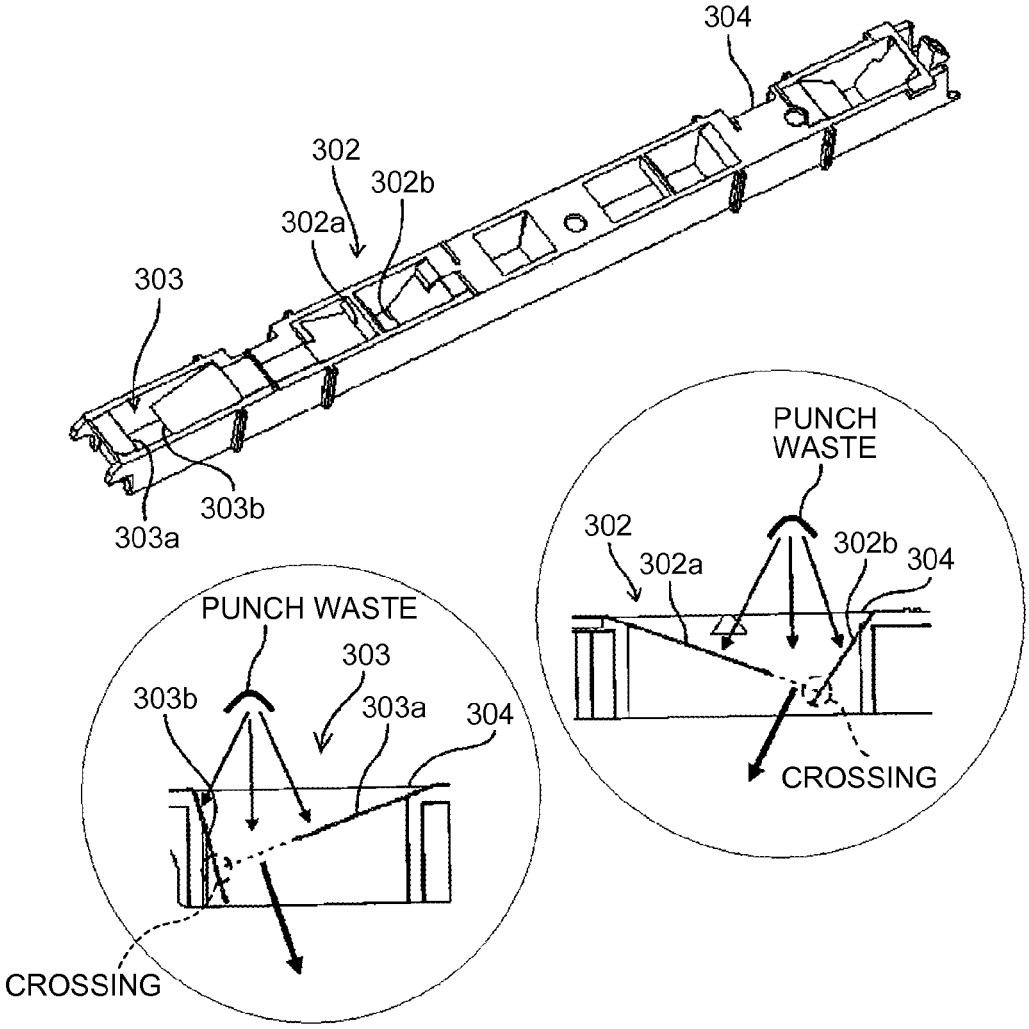
FIG. 28 is an upper perspective view of a guiding member configured to collect punch waste in the punch waste collection container.

FIG. 28 is an upper perspective view of a guiding member 304 provided in the puncher 320 of the punching unit 300 and configured to collect punch waste in the punch waste collection container 350. As illustrated in FIG. 27 and FIG. 28, the guiding member 304 is provided with a scattering direction restricting unit 302 and a scattering direction restricting unit 303 that restrict scattering directions of punch waste generated when holes are punched in the paper P. The scattering direction restricting unit 302 restricts scattering directions of punch waste upon punching performed by using the punch pins 301*b*, while the scattering direction restricting unit 303 restricts scattering directions of punch waste upon punching performed by using the punch pins 301*a*.

The scattering direction restricting unit 302 has a scattering direction restricting member 302*a* and a scattering direction restricting member 302*b*, which are a pair of plate-form members, and is arranged so that the tip of the scattering direction restricting member 302*a* and the end of the scattering direction restricting member 302*b* face each other with given space provided therebetween. Similarly, the scattering direction restricting unit 303 has a scattering direction restricting member 303*a* and a scattering direction restricting member 303*b*, which are a pair of plate-form members. The tip of the scattering direction restricting member 303*a* and the tip of the scattering direction restricting member 303*b* are arranged so as to face each other with given space provided therebetween. The scattering direction restricting member 302*a*, the scattering direction restricting member 302*b*, the scattering direction restricting member 303*a*, and the scattering direction restricting member 303*b* are attached on the guiding member 304 provided in the puncher 320 with an adhesive double-sided tape, for example.

With this configuration, the paths through which punch waste falling into the punch waste collection container 350 from the punching unit passes can be mainly as follows. As the first path, punch waste falls into the punch waste collection container 350 through an opening portion formed, in a punch waste falling direction from the puncher 320, by the scattering direction restricting member 302*a* and the scattering direction restricting member 302*b*. As the second path, punch waste fallen onto a side face of the scattering direction restricting member 302*a* from the puncher 320 slides down the side face and falls into the punch waste collection container 350 through the opening portion. As the third path, punch waste fallen onto a side face of the scattering direction restricting member 302*b* from the puncher 320 slides down the side face, and falls into the punch waste collection container 350 through the opening portion. It is preferable that the opening portion is slightly larger than an outer diameter of the punch pin 301*b*, at least.

In this configuration, the scattering direction restricting member 302*a*, and the scattering direction restricting member 302*b* can restrict scattering directions of punch waste fallen from the puncher 320 to given directions, thus making it easier that the punch waste falls into given positions in the punch waste collection container 350. In this configuration, the scattering direction restricting unit 302 restricts scattering directions of punch waste so that the punch waste falls onto the dispersing member provided in the punch waste collection container 350, which is described later, and thus the punch waste is guided to the dispersing member.

Meanwhile, in order to restrict scattering directions of punch waste using the scattering direction restricting unit 302, two or more scattering direction restricting members may be arranged so as to face each other to form the opening portion.

Figure 29:
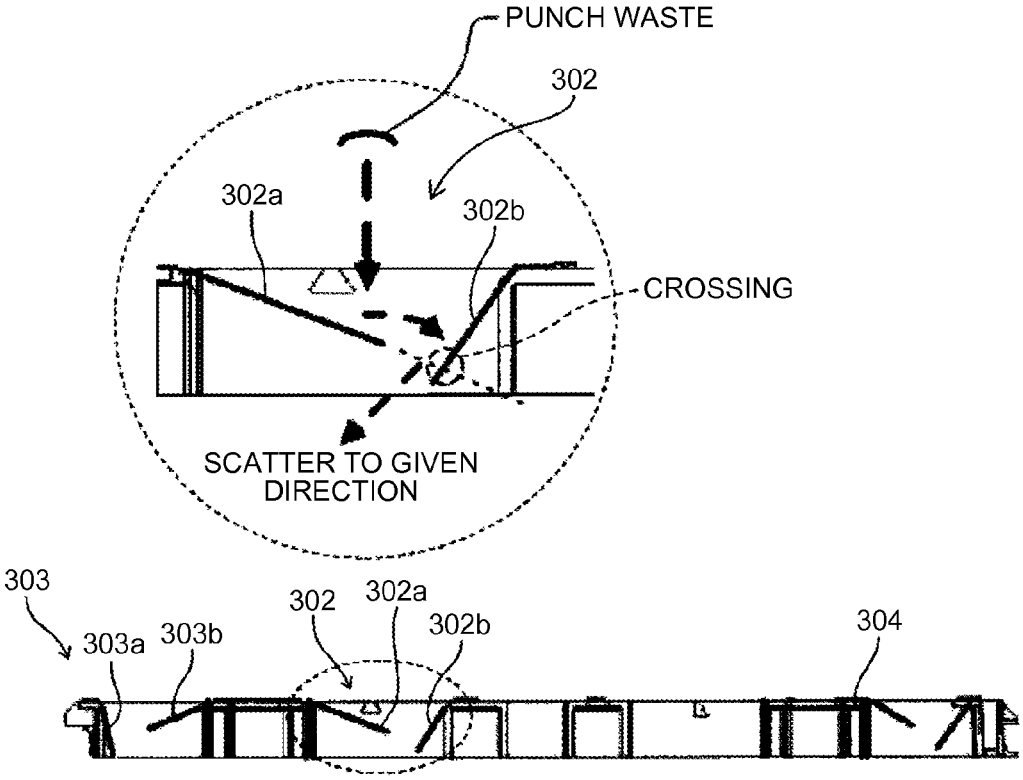
FIG. 29 is a diagram illustrating a case in which two or more restricting members facing each other are provided so that they are crossed.

As illustrated in FIG. 29, the tip of the scattering direction restricting member 302*a* and a side face of the scattering direction restricting member 302*b* may be arranged to face each other with given space provided therebetween.

With this configuration, the paths through which punch waste falling into the punch waste collection container 350 from the puncher passes can be mainly as follows. As the first path, punch waste falls into the punch waste collection container 350 through an opening portion formed, in a punch waste falling direction from the puncher 320, by the scattering direction restricting member 302*a* and the scattering direction restricting member 302*b*. As the second path, punch waste fallen onto a side face of the scattering direction restricting member 302*a* from the puncher 320 slides down the side face, and directly falls into the punch waste collection container 350 through the opening portion, or, after sliding down the side face, hits a side face of the scattering direction restricting member 302*b* once and then falls into the punch waste collection container 350 through the opening portion. As the third path, punch waste fallen onto a side face of the scattering direction restricting member 302*b* from the puncher 320 slides down the side face, and falls into the punch waste collection container 350 through the opening portion.

In this manner, when the tip of the scattering direction restricting member 302*a* and the side face of the scattering direction restricting member 302*b* face each other with given space provided therebetween, the scattering direction restricting unit 302 can further restrict scattering directions of punch waste fallen from the puncher 320.

The punch waste collection container 350 is provided therein with a dispersing member 306 and a dispersing member 307 that disperse accumulated positions of punch waste in the punch waste collection container 350. The dispersing member 306 disperses accumulated positions of punch waste generated in punching performed by the punch pin 301*b*, while the dispersing member 307 disperses accumulated positions of punch waste generated in punching performed by the punch pin 301*a*. The dispersing member 306 and the dispersing member 307 are attached in the punch waste collection container 350 with an adhesive double-sided tape, for example.

When punch waste is accumulated and reaches a detection area 309 that is set at a given height between the dispersing member 306 and the dispersing member 307 in the punch waste collection container 350, the full-state detecting unit 308 detects the height of punch waste, and detects that the punch waste collection container 350 is filled with punch waste.

In the punch waste collection container 350, punch waste generated in two-hole punching performed by the punch pin 301*b*, and punch waste generated in three-hole punching performed by the punch pin 301*a* are being accumulated. Thus, the full-state detecting unit 308 is provided, in the punch waste collection container 350, at a position where a height of accumulated punch waste generated in both punching operations can be detected. In this manner, the single full-state detecting unit 308 detects a height of accumulated punch waste generated in both punching operations, which can reduce costs, as compared with a case in which two or more full-state detecting units are provided in order to detect a height of accumulated punch waste separately in two-hole punching and in three-hole punching.

When the volume of the punch waste collection container 350 is small, it is required to secure that a certain amount of punch waste can be collected in the punch waste collection container 350. Thus, the punch waste collection container 350 is provided with the dispersing member 306 and the dispersing member 307 that have an inclined or arched face relative to the position of the detection area 309 of the full-state detecting unit 308, where the lower side of the face is positioned farther from the detection area 309 than the upper side thereof. In this way, it is possible, with the dispersing member 306 and the dispersing member 307, to control a position in the punch waste collection container 350 at which punch waste is accumulated initially to be a position farther from the full-state detecting unit 308. Therefore, it is possible to increase a collection amount of punch waste until punch waste reaches the detection area 309 of the full-state detecting unit 308, as compared with a case in which a position at which punch waste is accumulated initially is arranged near the detection area 309 of the full-state detecting unit 308.

Figure 30:
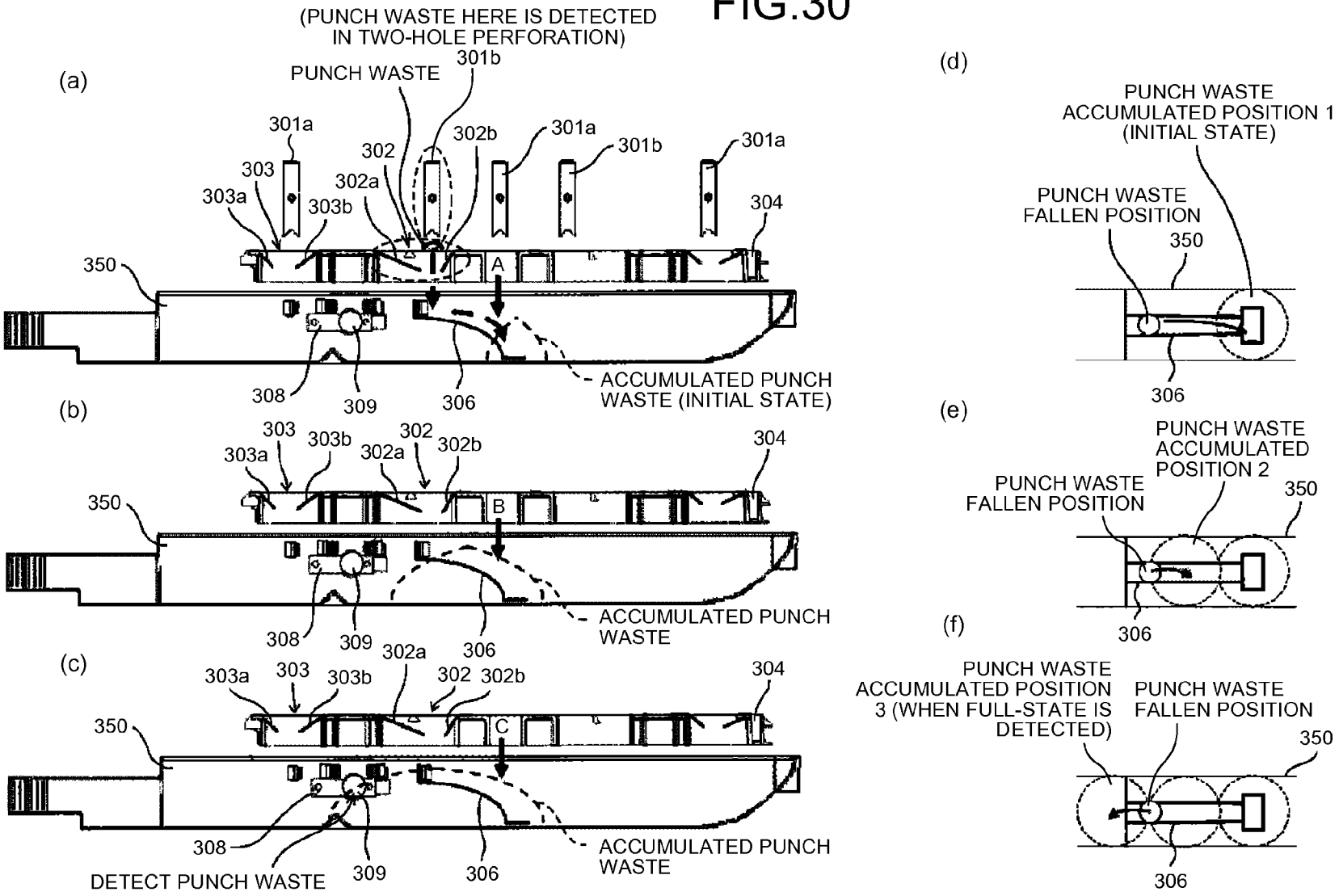
FIG. 30 is a schematic view illustrating states in two-hole punching from the initial accumulation of punch waste until the detection of an accumulated height of punch waste.

FIG. 30 illustrate states from the initial accumulation of punch waste generated in two-hole punching until the detection of the accumulated height of the punch waste by the full-state detecting unit 308. Note that the timing at which the full-state detecting unit 308 detects the accumulated height of punch waste is regarded as of "punch waste full-state", and is the timing for disposing of punch waste.

In the state (a) of FIG. 30, punch waste generated when holes are punched in the paper P falls into the punch waste collection container 350 while the scattering direction restricting unit 302 restricts a scattering direction thereof to one indicated by an arrow in the state (a) of FIG. 30. Then, the punch waste is guided by the dispersing member 306 to pass through a path indicated by an arrow in the state (a) of FIG. 30, and then accumulated in a punch waste accumulated position 1 in the punch waste collection container 350, as illustrated in the sate (d) of FIG. 30, etc. Here, the state as illustrated in the state (d) of FIG. 30, etc. represents an initial state of punch waste accumulation.

In the state (d) of FIG. 30, punch waste generated when holes are punched in the paper P falls into the punch waste collection container 350 while the scattering direction restricting unit 302 restricts a scattering direction thereof. The fallen punch waste falls into the punch waste collection container 350, and then the fallen punch waste is blocked by the punch waste that is already accumulated, in the manner as described above, in the punch waste accumulated position 1. Consequently, the punch waste is accumulated, as illustrated in the state (e) of FIG. 30, etc., in a punch waste accumulated position 2 that is a position nearer to the full-state detecting unit 308, as compared with the position in the initial state of punch waste accumulation.

In the state (c) of FIG. 30, punch waste generated when holes are punched in the paper P falls into the punch waste collection container 350 while the scattering direction restricting unit 302 restricts a scattering direction thereof to one indicated by an arrow in the state (c) of FIG. 30. The fallen punch waste falls into the punch waste collection container 350, and then the fallen punch waste is blocked by the punch waste that is already accumulated. Consequently, similarly to the case of the state (e) of FIG. 30, the punch waste is accumulated, as illustrated in the state (f) of FIG. 30, etc., in a punch waste accumulated position 3 that is a position still nearer to the full-state detecting unit 308. Then, the punch waste is being accumulated further in the punch waste collection container 350, and once the accumulated punch waste reaches the detection area 309 of the full-state detecting unit 308, the full-state detecting units 308 detects "punch waste full-state" detecting the punch waste.

Note that the scattering direction restricting units 302 and 303, and the dispersing members 306 and 307 are formed of a neutralizing material on which punch waste is hardly attached, which is effective for restricting scattering or dispersion of punch waste.

Configuration 2

Figure 31:
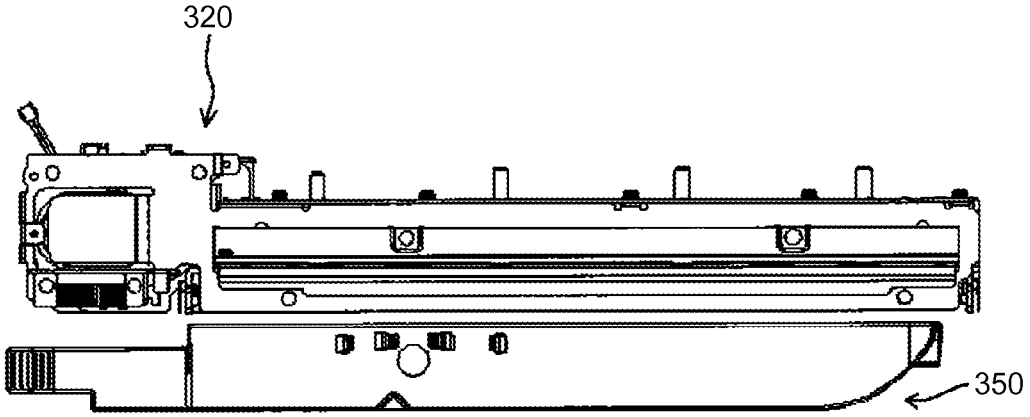
FIG. 31 is an outer lateral view of a puncher and a punch waste collection container that are provided in the punching unit capable of switching between two-hole punching and four-hole punching.
Figure 32:
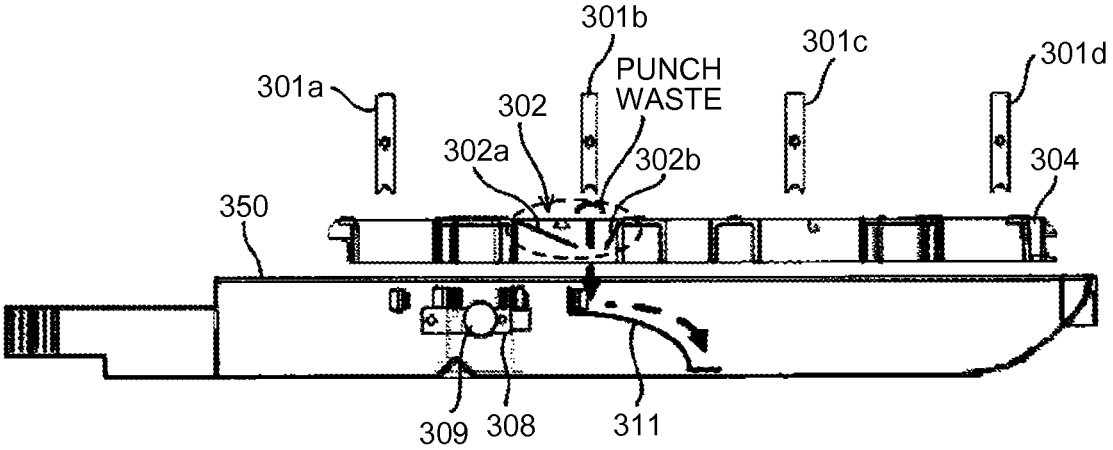
FIG. 32 is a sectional view of the punching unit capable of switching between two-hole punching and four-hole punching.

FIG. 31 is an outer lateral view of the puncher 320 and the punch waste collection container 350 that are provided in the punching unit 300 capable of switching between two-hole punching and four-hole punching. FIG. 32 is a schematic view of the guiding member 304 of the puncher 320 and the punch waste collection container 350 that are provided in the punching unit 300 capable of switching between two-hole punching and four-hole punching. In the puncher 320 of Configuration 2, a punch pin 301*b* and a punch pin 301*c* are used for two-hole punching, while the four punch pins 301*a*, 301*b*, 301*c*, and 301*d* are used for four-hole punching.

The full-state detecting unit 308 detects an accumulated height of punch waste generated by the punch pins 301*b* in both two-hole punching and four-hole punching. The guiding member 304 is provided with the scattering direction restricting unit 302 that restricts scattering directions of punch waste generated when a hole is punched in the paper P by the punch pin 301*b*. Moreover, the punch waste collection container 350 is provided therein with a dispersing member 311 that disperses accumulated positions of punch waste generated in punching performed by the punch pin 301*b*.

The techniques described in Configuration 1 can be applied to Configuration 2, with regard to the restriction of scattering directions of punch waste by the scattering direction restricting unit 302, the dispersion of punch waste in the punch waste collection container 350 by the dispersing member 311, and the method of efficiently accumulating punch waste in the punch waste collection container 350 so that the full-state detecting unit 308 detects an accumulated height of punch waste. Thus, the descriptions thereof are omitted in Configuration 2.

The above embodiments are explained by way of example only. The invention can achieve various effects specific to each embodiment as described below.

Embodiment A

A punching device includes a punching unit that punches a hole in a sheet of paper; a container that receives a chad of paper generated upon punching by the punching unit; a dispersing member that is provided within the container and that is configured to disperse the chad of paper; and a guiding member configured to guide the chad of paper that is generated upon punching by the punching unit and fallen into the container to the dispersing member. Thus, the efficiency of collecting punch waste into the container can be improved, as described in the above embodiments.

Embodiment B

In the embodiment A, the guiding member may include a pair of plate-form members that are arranged so that a tip of one plate-form member and a side face of the other plate-form member face each other with given space provided therebetween. Thus, the efficiency of collecting punch waste into the container can be improved, as described in the above embodiments.

Embodiment C

In the embodiment A, the punching device may further include an accumulated height detecting unit configured to detect an accumulated height of the punch waste collected in the container, and may detect that the container is filled with the punch waste based on a detected result of the accumulated height detecting unit. Thus, the efficiency of collecting punch waste into the container can be improved while suppressing the punch waste from spilling from the container, as described in the above embodiments.

Embodiment D

In the embodiment C, the dispersing member may have an inclined or arched face relative to a given detection position at which the accumulated height detecting unit detects an accumulated height of the chads of paper, and a lower side of the face may be positioned farther from the given detection position than the upper side thereof. Thus, it is possible to increase a collection amount of punch waste until the punch waste reaches the given detection position, as compared with a case in which a position at which punch waste is accumulated initially is arranged near the given detection position.

Embodiment E

In the embodiment A, at least one of the guiding member and the dispersing member may be formed of a neutralizing material. Thus, as described in the above embodiments, punch waste is hardly attached on the guiding member and the dispersing member, which is effective for restricting the scattering or the dispersion of punch waste.

Embodiment F

A paper processing apparatus includes a paper processing unit that performs given processing on a sheet of paper; and the punching device according to the embodiment A. Thus, the efficiency of collecting punch waste into the container can be improved, as described in the above embodiments.

Embodiment G

An image forming apparatus includes an image forming unit that forms an image on a sheet of paper, and the punching device according to the embodiment A for punching a hole in the sheet of paper on which the image is formed by the image forming unit. Thus, the efficiency of collecting punch waste into the container can be improved, as described in the embodiment.

Embodiment H

An image forming apparatus includes an image forming unit that forms an image on a sheet of paper, and the paper processing unit according to the embodiment F for performing given processing on the sheet of paper on which the image is formed by the image forming unit, as described in the above embodiments.

In the present invention, the guiding member guides chads of paper to the dispersing member. Thus, it is possible, with the dispersing member, to efficiently disperse the chads of paper in a collection container, as compared with a case in which chads of paper is not guided by the guiding member. Therefore, the efficiency of collecting chads of paper in a collection container can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A punching device, comprising:

a punching unit that punches a hole in a sheet of paper;

a container that receives a chad of paper generated upon punching by the punching unit;

a dispersing member that is provided within the container and that is configured to disperse the chad of paper; and a guide member configured to guide the chad of paper, that is generated upon punching by the punching unit, into the container to the dispersing member, wherein the guiding member includes a pair of plate-form members that extend into an opening in the guiding member such that a plane that extends along a guide surface of a first of the pair of plate-form members and extends from a free end of the first plate-form member intersects with a side face of a second of the pair of plate-form members.

2. The punching device according to claim 1, wherein the pair of plate-form members are arranged so that a tip of one plate-form member and a side face of the other plate-form member face each other with a space provided therebetween.

3. The punching device according to claim 1, further comprising an accumulated height detecting unit configured to detect an accumulated height of chads of paper collected in the container, wherein the punching device unit detects that the container is filled with the chads of paper based on a detected result of the accumulated height detecting unit.

4. The punching device according to claim 3, wherein the dispersing member has an inclined or arched face relative to a given detection position at which the accumulated height detecting unit detects an accumulated height of the chads of paper, and a lower side of the face is positioned farther from the given detection position than an upper side thereof.

5. The punching device according to claim 1, wherein at least one of the guiding member and the dispersing member is formed of a neutralizing material.

6. A paper processing apparatus, comprising:

a paper processing unit that performs given processing on a sheet of paper; and the punching device according to claim 1.

7. An image forming apparatus, comprising:

an image forming unit that forms an image on a sheet of paper; and the punching device according to claim 1 for punching a hole in the sheet of paper on which the image is formed by the image forming unit.

8. An image forming apparatus, comprising:

an image forming unit that forms an image on a sheet paper;

the paper processing unit according to claim 6 for performing given processing on the sheet of paper on which the image is formed by the image forming unit.

* * * * *